US009695536B2

(12) United States Patent
Shomura

(10) Patent No.: US 9,695,536 B2
(45) Date of Patent: Jul. 4, 2017

(54) OVERLOCK SEWING MACHINE

(71) Applicant: Janome Sewing Machine Co., Ltd., Tokyo (JP)

(72) Inventor: Eiichi Shomura, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 180 days.

(21) Appl. No.: 14/796,967

(22) Filed: Jul. 10, 2015

(65) Prior Publication Data

US 2016/0215425 A1 Jul. 28, 2016

(30) Foreign Application Priority Data

Jan. 26, 2015 (JP) ..... 2015-12773

(51) Int. Cl.
*D05B 57/00* (2006.01)
*D05B 87/02* (2006.01)
(Continued)

(52) U.S. Cl.
CPC ..... *D05B 87/02* (2013.01); *D05B 57/02* (2013.01); *D05B 69/36* (2013.01)

(58) Field of Classification Search
CPC ..... D05B 57/02; D05B 87/02; D05B 1/12; D05B 1/20; D05B 57/24; D05B 63/00; D05D 2207/04
(Continued)

(56) References Cited

U.S. PATENT DOCUMENTS 4,503,794 A * 3/1985 Ishihara ..... D05B 27/04 112/313
4,543,896 A * 10/1985 DeSantis ..... D05B 57/06 112/162
(Continued)

FOREIGN PATENT DOCUMENTS

EP 2762627 A1 8/2014
JP H09-38369 A 2/1997
(Continued)

OTHER PUBLICATIONS

Combined Search and Examination Report dated Feb. 22, 2016, issued in Patent Application No. GB1515621.9 filed in United Kingdom (5 pages).
(Continued)

*Primary Examiner* — Tejash Patel
(74) *Attorney, Agent, or Firm* — Nakanishi IP Associates, LLC

(57) ABSTRACT

In an overlock sewing machine, a main shaft fixing operating shaft is provided with a differentiation ring that can be swung in a predetermined range such that, when the rotation of a main shaft is to be enabled, it is set to an enable state in a stationary state, and when the rotation of the main shaft is disabled, it is swung and shifted from the enable position. Furthermore, a looper cover open/closed detection configuration is configured by modifying a part of a typical known configuration. Such an arrangement provides an overlock sewing machine having a simple configuration that requires only a single micro switch to detect the switching between the threading mode and the sewing mode and to detect the open/closed state of the looper cover.

2 Claims, 18 Drawing Sheets

(51) Int. Cl.
*D05B 57/02* (2006.01)
*D05B 69/36* (2006.01)

(58) Field of Classification Search
USPC ..... 112/199
See application file for complete search history.

(56) References Cited

U.S. PATENT DOCUMENTS 4,967,677 A * 11/1990 Seiriki ..... D05B 1/12 112/162
4,977,842 A * 12/1990 Fukao ..... D05B 87/02 112/154
5,301,622 A * 4/1994 Sakuma ..... D06B 57/06 112/162
5,327,841 A * 7/1994 Sakuma ..... D05B 87/00 112/162
5,513,588 A * 5/1996 Kojima ..... D05B 1/20 112/197
6,101,960 A * 8/2000 Ebata ..... D05B 7/063 112/122
6,880,472 B2 * 4/2005 Horiuchi ..... D05B 87/02 112/199
8,939,097 B2 * 1/2015 Suzuki ..... D05B 87/02 112/199
9,194,069 B2 * 11/2015 Shomura ..... D05B 87/00
9,340,910 B2 * 5/2016 Shomura ..... D05B 57/34
2008/0236466 A1 * 10/2008 Sadasue ..... D05B 57/30 112/302
2012/0210922 A1 * 8/2012 Sakuma ..... D05B 87/00 112/199
2014/0083344 A1 * 3/2014 Sakuma ..... D05B 87/00 112/199
2014/0190383 A1 7/2014 Ishikawa
2015/0267332 A1 9/2015 Shomura

FOREIGN PATENT DOCUMENTS

JP 2013-063221 A 4/2013
WO 2014/010108 A1 1/2014

OTHER PUBLICATIONS

Australian Patent Examination Report dated Mar. 2, 2016, issued in Australian Patent Application No. 2015213277 (4 pages).

* cited by examiner

OVERLOCK SEWING MACHINE

CROSS REFERENCE TO RELATED APPLICATIONS

This application is based on and claims the benefit of priority to Japanese Patent Application No. 2015-012773 filed on Jan. 26, 2015, the contents of which are hereby incorporated by reference in their entirety.

BACKGROUND OF THE INVENTION

Field of the Invention

The present invention relates to an overlock sewing machine that is capable of threading a looper thread though a looper using air pressure.

Background Art

An overlock sewing machine is provided with multiple loopers. There is a need to thread a different looper thread through each of the loopers, which requires a troublesome threading operation.

Also, sewing machines are known that are configured to supply thread using compressed air such that it reaches a looper point having a hollow structure. Such a threading operation for threading a looper using compressed air is an operation that is completely different from a sewing operation. Thus, in order to allow each component of the sewing machine to perform its operation, each component must be set to an appropriate state. For example, sewing must not be performed while a looper cover remains open.

A technique has been disclosed in Patent Literature 1, in which, in an overlock sewing machine configured to perform its operations using a single motor and to switch its operations by means of clutch switching between a pump driving operation for supplying thread using compressed air such that it reaches a looper point having a hollow structure and a main shaft driving operation for sewing, abnormal switching between the threading mode and the sewing mode is prohibited.

PRIOR ART LITERATURE

Patent Literature

[Patent Literature 1]

Japanese Patent Application Laid Open No. 2013-63221

However, in the technique described in Patent Literature 1, the mechanism in the vicinity of a detection switch configured to operate together with the switching between the threading mode and the sewing mode has a small size and a complicated configuration. This leads to difficulty in assembling such a detection switch. In addition, this leads to an increase in cost. This is because such an air pressure threading apparatus is not configured as a simple structure formed of pipe members connected to each other. The air pressure threading apparatus further has a switching mechanism for switching between the threading mode and the sewing mode. Furthermore, such a configuration is integrated in a small space below the front cover. In a case in which such components related to the detection switch are arranged so as to operate together with the switching mechanism, this results in a complicated mechanism having a very small size. In particular, with an arrangement described in Patent Literature 1 described above, the motor clutch mechanism is arranged in the same space, leading to an even more complicated mechanism.

For the reasons described above, the technique described in Patent Literature 1 has low feasibility. Presently, there is no known commercially-available sewing machine having such a mechanism disclosed in Patent Literature 1. As an example of a commercially-available sewing machine, an arrangement is known in which a looper cover open/closed detection switch is arranged as a dedicated component for only detecting whether the looper cover is open or closed. Furthermore, the sewing machine is configured such that, when a threading-mode/sewing-mode switching knob is set to the threading mode, the switching knob is also used to control the looper cover such that the looper cover cannot be closed. That is to say, when the sewing machine is in the threading mode, the looper cover cannot be closed. In this state, the looper cover open/closed detection switch detects that the looper cover is open, thereby disabling the sewing operation of the sewing machine. However, with such a sewing machine, such a looper cover open/closed detection switch is arranged as a dedicated component so as to provide such a single function only. Such an arrangement requires a dedicated space for such a detection switch, leading to difficulty in configuring the sewing machine with a compact size. Furthermore, such an arrangement requires an increased number of components, leading to an increase in cost.

SUMMARY OF THE INVENTION

One or more embodiments of the present invention, an overlock sewing machine is provided having a simple configuration configured to use a single switch to detect switching between the threading mode and the sewing mode and to detect whether the looper cover is open or closed.

Embodiment (1)

One or more embodiments of the present invention, an overlock sewing machine comprises: a swing lever portion arranged such that the swing lever can be swung in a predetermined range such that the swing lever is set to an enable position in a stationary state when rotation of a main shaft is to be enabled, and such that the swing lever is swung and shifted to a position away from the enable position when the rotation of the main shaft is to be disabled; a switch that switches a motor configured to drive the main shaft between a driving enable state and a driving disable state; a detection lever arranged such that the detection lever can be swung with a swinging axis that extends in a direction that differs from the direction in which the swinging axis of the swing lever portion extends, and configured to be swung between an operation enable position at which the switch is set to the motor driving enable state and an operation disable position at which the switch is set to the motor driving disable state; a detection lever spring that applies a force to the detection lever toward the operation disable position; a cover detection shaft arranged such that it extends along a direction in which the swinging axis of the swing lever portion extends, and configured such that it can be shifted to a position so as to press and shift the detection lever from the operation disable position to the operation enable position; a cover detection shaft spring that applies a force to the cover detection shaft so as to increase a distance between the cover detection shaft and the detection lever; a looper cover arranged so as to cover at least a part of the looper, and configured to be opened and closed; a pressing portion configured to be shifted together with the looper cover as a single unit, and to press the cover detection shaft such that the cover detection shaft approaches the detection lever when the looper cover is set to a closed position; a looper cover spring that applies a force to the looper cover such that, when the looper cover is set to a closed state, the cover detection shaft is shifted against the force applied by the cover detection shaft spring and the force applied by the detection lever spring so as to shift the detection lever from the operation disable position to the operation enable position; and an operation limiting portion that limits an operation of the detection lever according to the position of the swing lever portion such that, when the swing lever portion is set to the enable position, the detection lever can be swung and shifted to the operation enable position, and such that, when the swing lever portion is not set to the enable position, the detection lever cannot be swung and shifted to the operation enable position.

Embodiment (2)

One or more embodiments of the present invention, the overlock sewing machine according to the aforementioned first embodiment comprises: at least one looper having a receiving opening that receives a looper thread and having a hollow structure through which the looper thread can pass; a thread insertion opening into which the looper thread is to be inserted such that the looper thread passes through the looper; a looper conducting pipe that guides the looper thread inserted into the looper inserting opening to the receiving opening; a slide pipe arranged between the looper conducting pipe and the receiving opening such that one end thereof is slidably fitted to the looper conducting pipe, such that the other end thereof can be shifted between a threading position at which the other end thereof is connected to the receiving opening and a sewing position at which the other end thereof is distant from the receiving opening; a slide member configured to hold the slide pipe and to be shifted together with the slide pipe between the threading position and the sewing position, and having a long hole portion that extends along a direction in which the slide member is to be shifted, and a wide hole portion configured to have a width that is greater than that of the long hole portion, and to communicate with the long hole portion; a slide member spring that applies a force to the slide member and the slide pipe toward the receiving opening side; a main shaft to be rotationally driven; a main shaft fixing plate fixed to the main shaft and having a notch at a position on an outer circumferential face that corresponds to a threading phase at which the receiving opening can be connected to the aforementioned other end of the slide pipe; a first shaft configured such that one end thereof can be shifted between an engagement position at which the aforementioned one end thereof is engaged with the notch so as to set the main shaft to the threading phase and a retracted position at which there is a sufficient distance between the aforementioned one end thereof and the main shaft fixing plate, and such that the other end thereof has a small-diameter portion to be engaged with the long hole portion of the slide member and a large-diameter portion to be engaged with the wide hole portion of the slide member, and configured such that the small-diameter portion and the large-diameter portion can respectively be engaged with the long hole portion and the wide hole portion so as to allow the position of the slide member to be set to the threading position and otherwise the sewing position; a second shaft configured to be relatively shifted along the axial direction of the first shaft; a shaft spring that applies a force so as to increase a distance between the first axis and the second axis; a shaft pin configured such that it protrudes from the second shaft, or is otherwise configured as a shaft pin engaged with the second shaft such that it can be shifted together with the second shaft as a single unit in an axial direction of the second shaft; an engaging portion provided to the first shaft, and engaged with the shaft pin and/or the second shaft so as to receive a force that shifts the first shaft toward the main shaft fixing plate side. The swing lever portion comprises a main shaft fixing operating arm portion including a shaft pin engaging portion engaged with the shaft pin or otherwise the shaft pin itself, and a switch limiting portion that can be swung together with the main shaft fixing operating arm portion as a single unit. Furthermore, the overlock sewing machine further comprises: a main shaft fixing operating spring configured to apply a force in a direction that is switched between both directions in which the swing lever portion can be swung when the swing lever portion is swung across a neutral position; a switch operating portion provided so as to allow a user to perform an operation; and a switch interlocking portion (switch interlocking arm) comprising a switch engaging portion engaged with the switch limiting portion, and configured to operate so as to swing the swing lever portion according to an operation performed via the switch operating portion, and a slide member engaging portion that can be engaged with the slide member so as to shift the position of the slide member to the sewing position when the switch operating portion is set to the sewing position.

One or more embodiments of the present invention, an overlock sewing machine is provided having a simple configuration configured to use a single switch to detect switching between the threading mode and the sewing mode and to detect whether the looper cover is open or closed.

DETAILED DESCRIPTION

Description will be made with reference to drawings or the like regarding ideal embodiments for providing the present invention.

Embodiment

Figure 1:
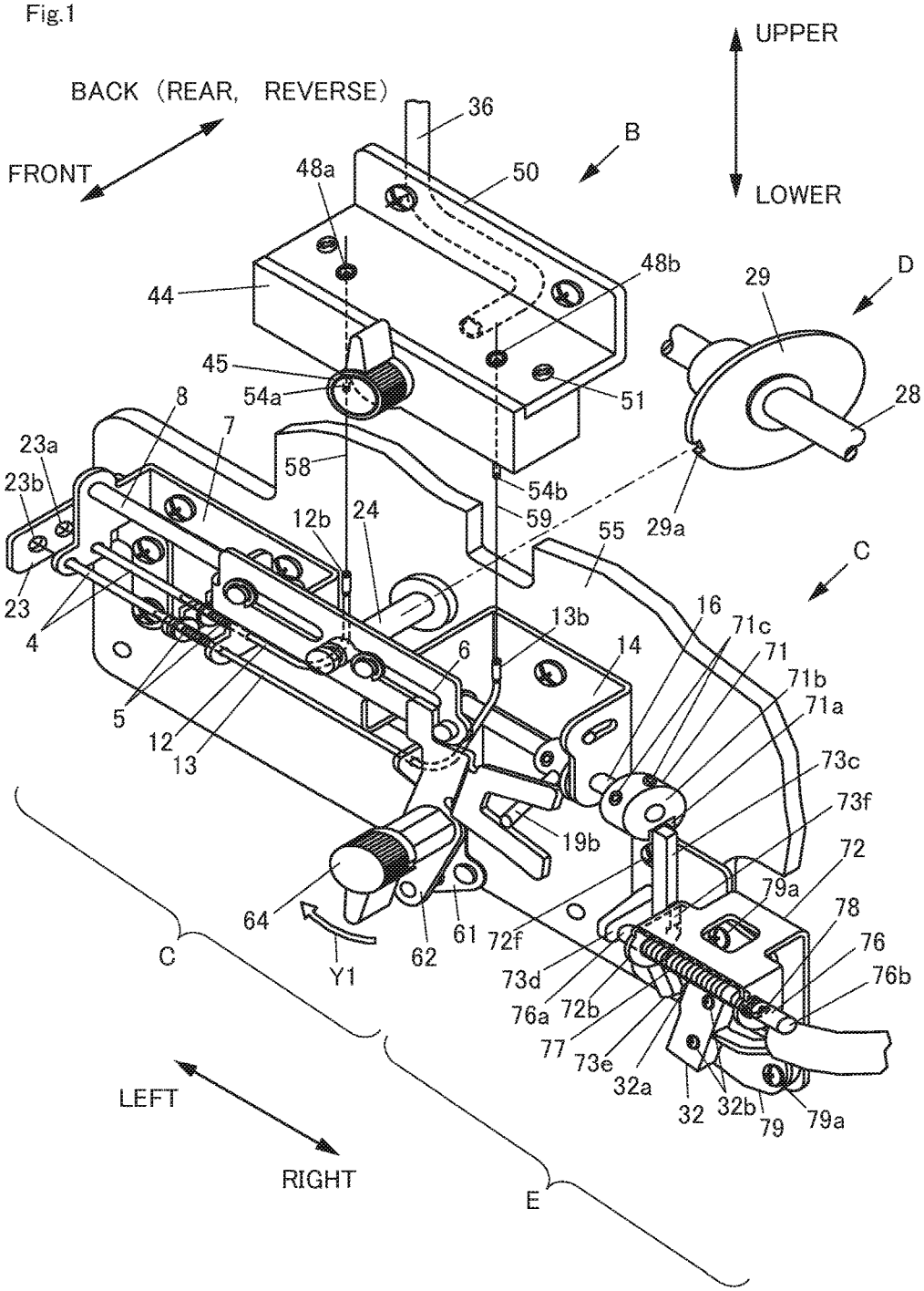
FIG. 1 is a perspective view showing the main components of an overlock sewing machine according to an embodiment of the present invention.

FIG. 1 is a perspective view showing the main components of an overlock sewing machine according to an embodiment of the present invention.

Figure 2:
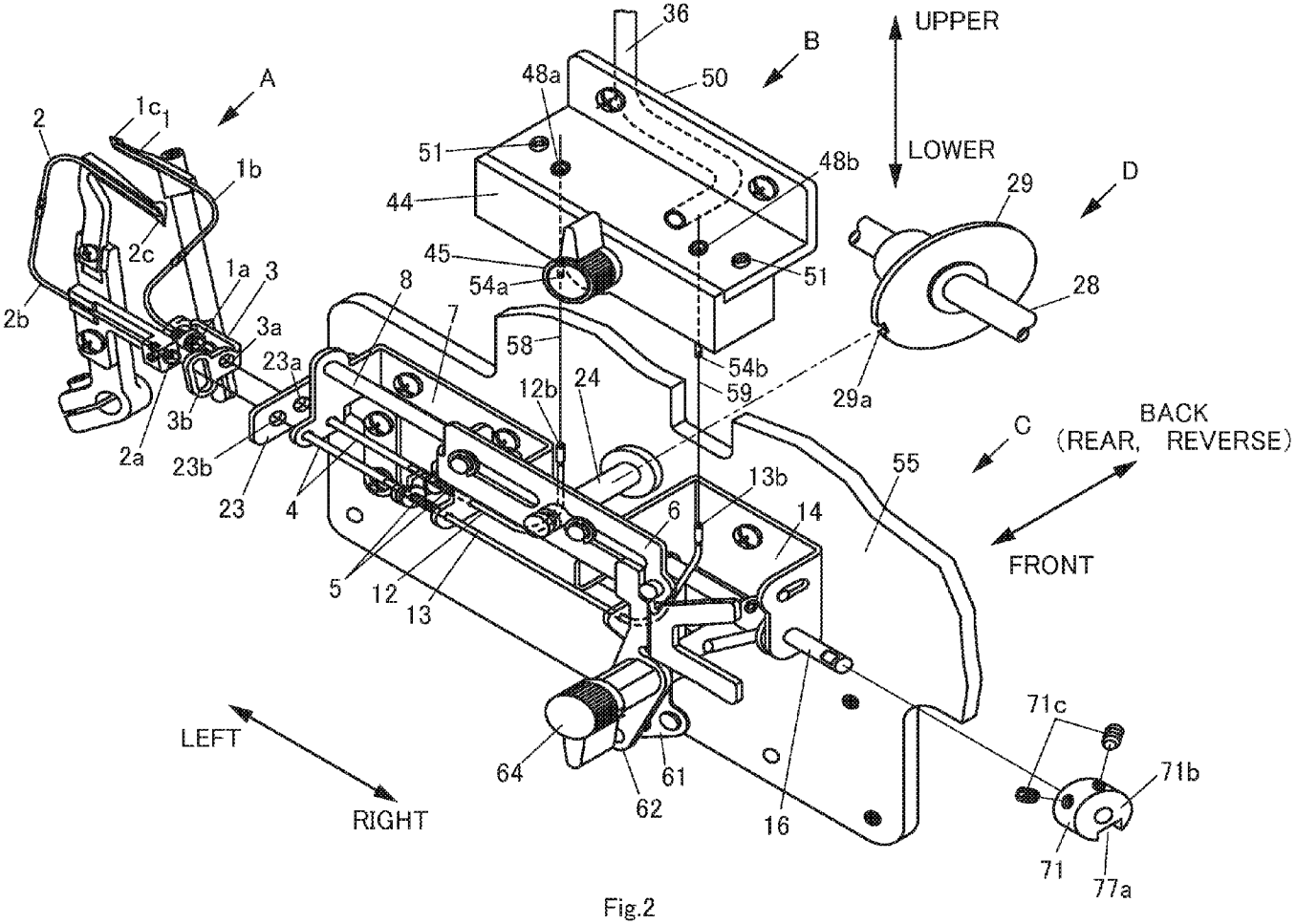
FIG. 2 is a perspective view showing the components in the vicinity of a looper thread path C.

FIG. 2 is a perspective view showing the components in the vicinity of a looper thread path C.

Figure 3:
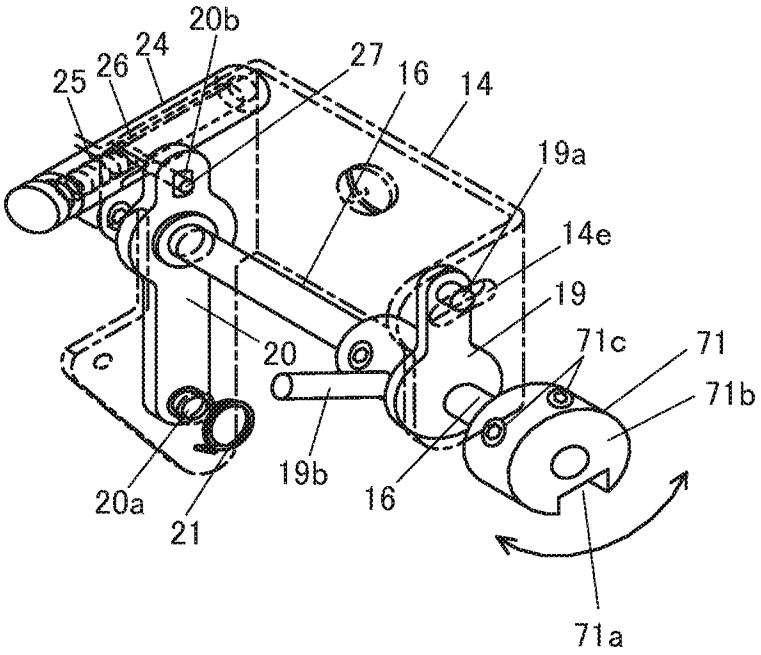
FIG. 3 is a perspective view showing the components in the vicinity of the right end of the looper thread path C in a state as seen through a slide plate support 14.

FIG. 3 is a perspective view showing the components in the vicinity of the right end of the looper thread path C in a state as seen through a slide plate support 14.

Figure 4:
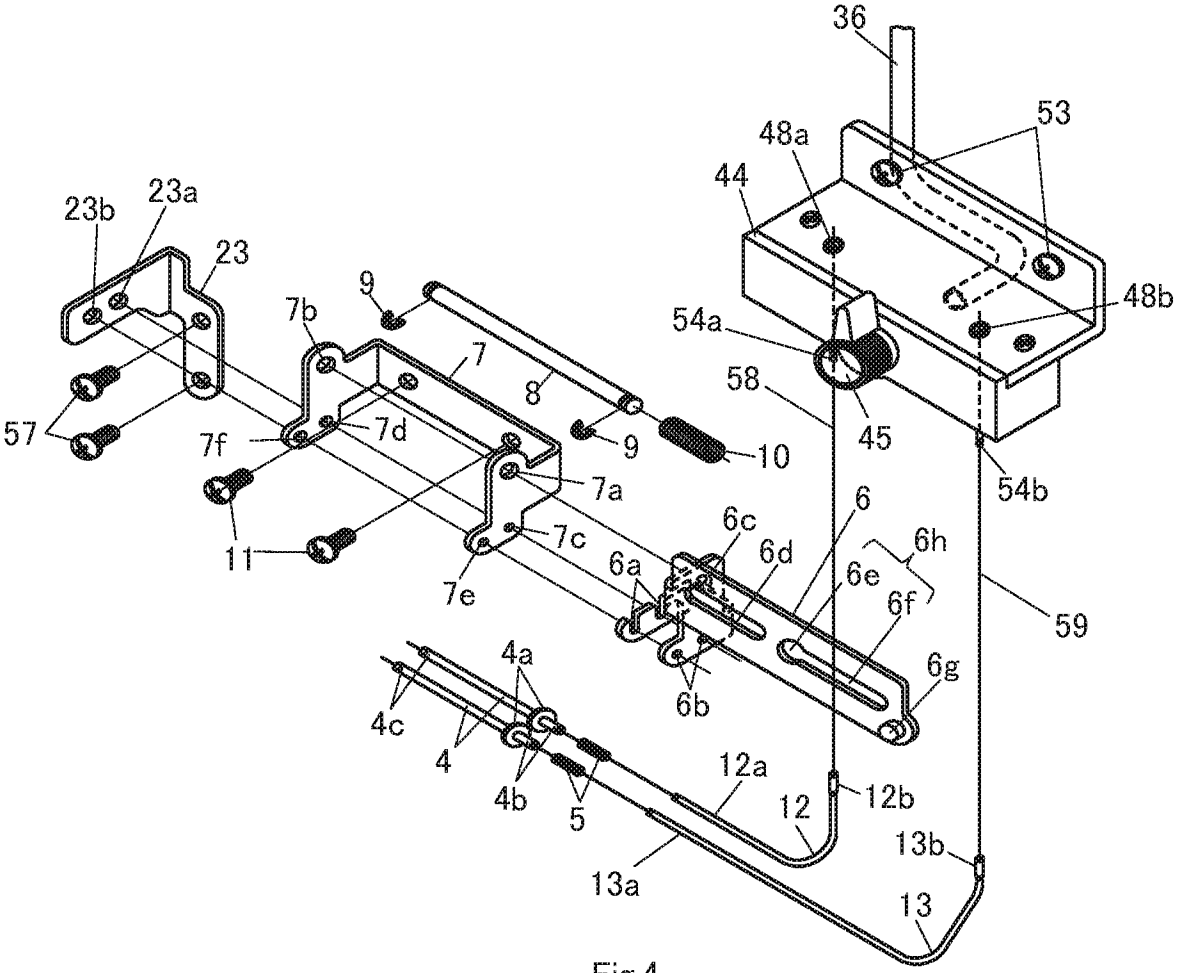
FIG. 4 is an exploded perspective view showing the components in the vicinity of a slide plate 6 of the looper thread path C.

FIG. 4 is an exploded perspective view showing the components in the vicinity of a slide plate 6 of the looper thread path C.

Figure 5:
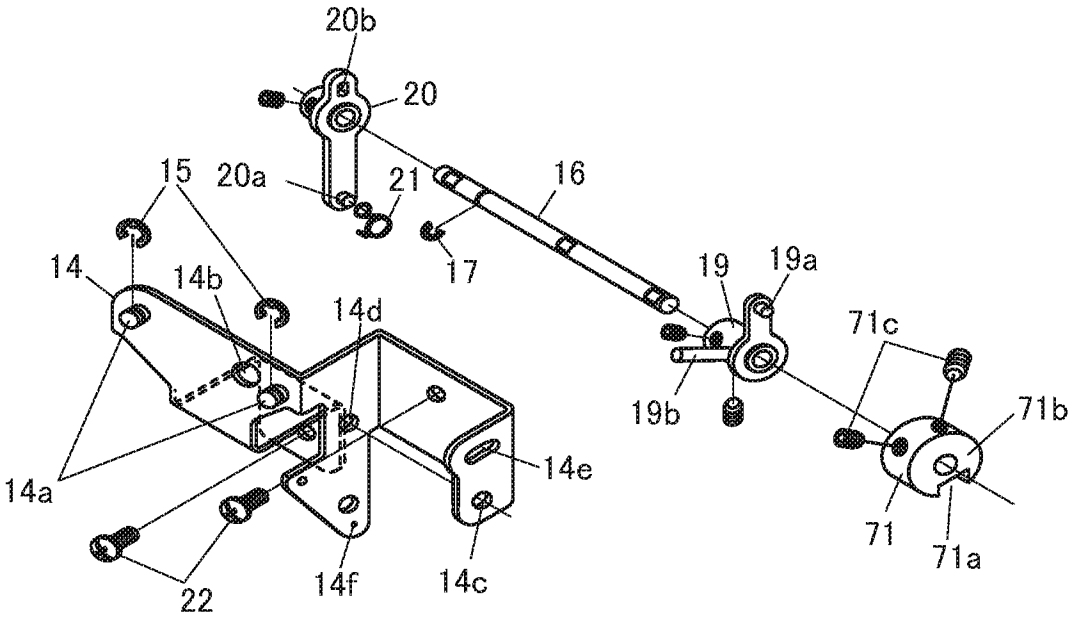
FIG. 5 is an exploded perspective view showing the components in the vicinity of the slide plate support 14 of the looper thread path C.

FIG. 5 is an exploded perspective view showing the components in the vicinity of the slide plate support 14 of the looper thread path C.

Figure 6:
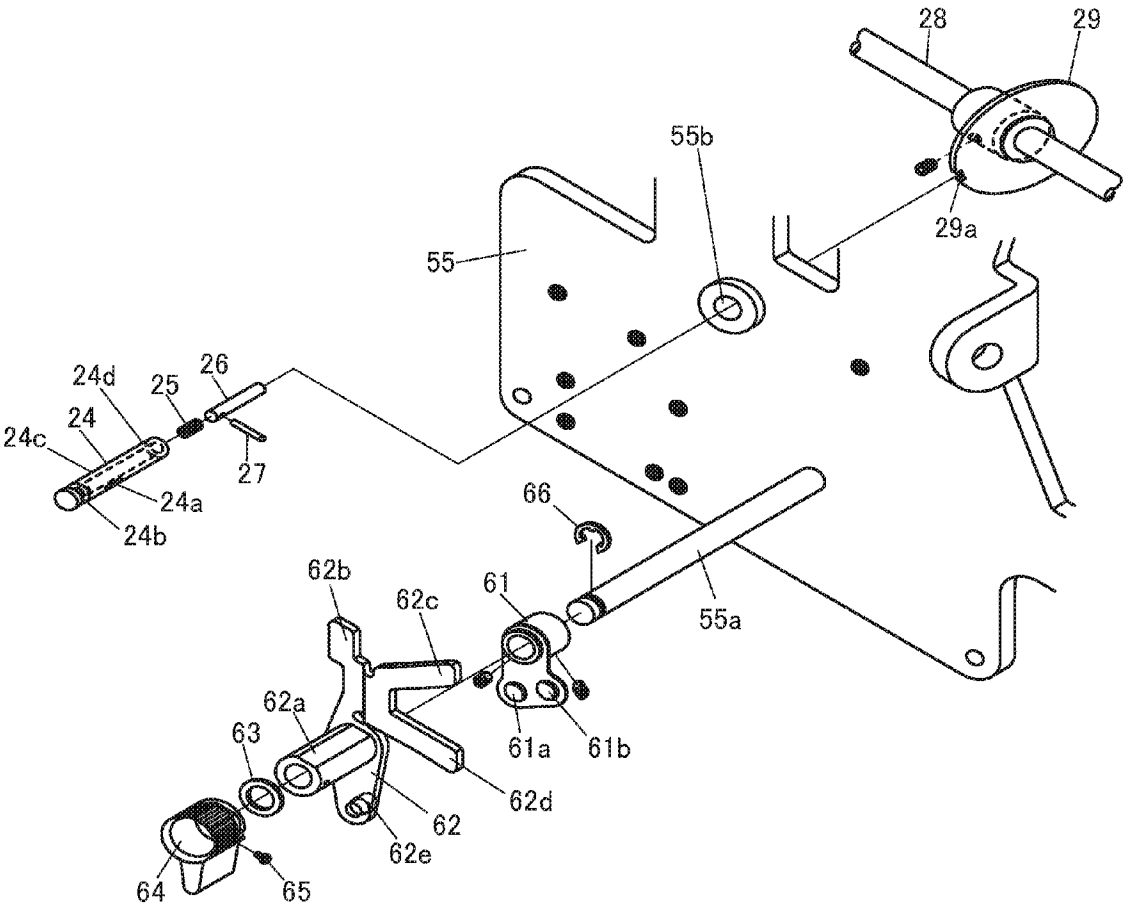
FIG. 6 is an exploded perspective view showing the components in the vicinity of a main shaft fixing mechanism D.

FIG. 6 is an exploded perspective view showing the components in the vicinity of a main shaft fixing mechanism D.

It should be noted that FIGS. 1 through 6 and subsequent diagrams each show a schematic configuration. For ease of understanding, each component is shown with a different size or different shape as appropriate.

Also, description will be made regarding an arrangement with specific values, shapes, materials, etc. However, such factors may be changed as appropriate.

Also, for ease of understanding and for convenience of description, description will be made as appropriate using six directions, i.e., the front side (forward side), back side (rear side, reverse side), left side, right side, upper side, and lower side, as indicated by the arrows in FIG. 1. However, such directions by no means restrict the configuration of the invention.

Description will be made in the present embodiment regarding an overlock sewing machine including two loopers (upper looper 1 and lower looper 2). It should be noted that the present invention is applicable to an overlock sewing machine including a single looper or three or more loopers to be threaded.

An overlock sewing machine according to the present embodiment includes, as main components, a looper portion A, an air flow path switching mechanism B, a looper thread path C, a main shaft fixing mechanism D, and a safety mechanism E, as shown in FIGS. 1 and 2. It should be noted that, in addition to the aforementioned components, the overlock sewing machine further includes a needle, a motor, and various kinds of driving mechanisms. However, detailed description thereof will be omitted.

The looper portion A includes an upper looper 1 and a lower looper 2 each having a hollow structure, and each configured to respectively receive an upper looper thread 58 and a lower looper thread 59 transferred via the air flow path switching mechanism B and the looper thread path C. The upper looper 1 and the lower looper 2 respectively have an upper looper receiving opening 1*a* and a lower looper receiving opening 2*a* each configured to receive the corresponding looper thread.

The upper looper receiving opening 1*a* is formed such that a thread can reach an upper looper point 1*c* via a pipe-like member 1*b*. The lower looper receiving opening 2*a* is formed such that a thread can reach a lower looper point 2*c* via a pipe-like member 2*b*. A looper thread take-up 3 includes an upper looper thread hook 3*a* and a lower looper thread hook 3*b*. The upper looper 1 and the lower looper 2 are driven in a reciprocal manner in synchronization with the crossing timing of an unshown needle that is driven in the vertical direction according to the rotation of the main shaft 28 driven by an unshown motor.

The air flow path switching mechanism B is a mechanism that switches the path of compressed air supplied via a tube 36, so as to switch the threading mode between the upper looper thread 58 threading mode and the lower looper thread 59 threading mode. The air flow path switching mechanism B has a configuration in which a branching body 44 is fixedly mounted on a branching base plate 50 by means of screws 51, and the tube 36 is connected to the back face thereof. The compressed air generated by a compressed air supply apparatus (not shown) is supplied to the air flow path switching mechanism B.

A looper selecting knob 45 is provided to the front face of the air flow path switching mechanism B. In the threading operation, switching is performed between the upper looper thread 58 threading and the lower looper thread 59 threading according to operation of the looper selecting knob 45.

An upper looper thread inserting hole 48*a* and a lower looper thread inserting hole 48*b* are provided to the upper face of the air flow path switching mechanism B.

The air flow path switching mechanism B includes an upper looper thread discharge pipe 54*a* and a lower looper thread discharge pipe 54*b* on its lower end side, which are respectively connected to an upper end expanding portion 12*b* of an upper looper conducting pipe 12 and an upper end expanding portion 13*b* of a lower looper conducting pipe 13 described later.

Furthermore, the air flow path switching mechanism B is fixedly mounted on the sewing machine main body or otherwise a unit base 55 by screws 53.

Each slide pipe 4 is arranged such that it receives a slide pipe spring 5 via its flange portion 4*a*, and is inserted into a U groove 6*a* of a slide plate 6 with the flange portion 4*a* as a receiving face. Each slide pipe 4 is arranged such that its end 4*b* is slidably fitted to the corresponding looper conducting pipe, i.e., the upper looper conducting pipe 12 or otherwise the lower looper conducting pipe 13. Furthermore, the slide pipe 4 can be shifted between the threading position and the sewing position according to the shifting of the slide plate 6. At the threading position, the other end 4*c* of the slide pipe 4 is in a state in which it is connected to the corresponding looper receiving opening, i.e., the upper looper receiving opening 1*a* or otherwise the lower looper receiving opening 2*a*. At the sewing position, the other end 4*c* of the slide pipe 4 is in a state in which it is separated from the corresponding looper receiving opening, i.e., the upper looper receiving opening 1*a* or otherwise the lower looper receiving opening 2*a*.

The slide pipe springs 5 are respectively fitted to the corresponding slide pipes 4, which allow the slide pipes 4 to be respectively pressed into contact with the upper looper receiving opening 1*a* and the lower looper receiving opening 2*a* when the slide pipes 4 are shifted to the threading position.

The slide plate (slide member) 6 has two round holes 6*b* that respectively face the two U grooves 6*a*. A portion of the slide plate 6 having the U grooves 6*a* and the round holes 6*b* is arranged in the inner space defined by a looper pipe supporting plate 7 (space defined between facing portions of the looper pipe supporting plate 7 described later). The slide plate 6 supports the slide pipes 4, and is configured to be shifted together with the slide pipes 4 between the threading position and the sewing position.

The looper pipe supporting plate 7 is provided with facing portions on both sides thereof along the horizontal direction such that they protrude toward the front side and such that they face each other (i.e., a so-called U-shaped structure). Through holes 7*a* and 7*b* are provided to the facing portions of the looper pipe supporting plate 7. Furthermore, a round hole 6*c* is provided to the face of the slide plate 6 in which the aforementioned two round holes 6*b* are formed, such that it corresponds to the through holes 7*a* and 7*b*.

A supporting plate shaft 8 is arranged such that it passes through the through holes 7*a* and 7*b* of the looper pipe supporting plate 7, and passes through the round hole 6*c* of the slide plate 6 arranged between the through holes 7*a* and 7*b*. Furthermore, E-shaped snap rings 9 are respectively provided to both ends of the supporting plate shaft 8, so as to fixedly mount the supporting plate shaft 8 on the looper pipe supporting plate 7. The supporting plate shaft 8 supports a supporting plate shaft spring 10 between the round hole 6*c* of the slide plate 6 and the through hole 7*a* of the looper pipe supporting plate 7. The looper pipe supporting plate 7 is fixedly mounted on an unshown sewing machine main body or otherwise the unit base 55 by means of screws 11. Thus, a force is applied to the slide plate 6 by means of the supporting plate shaft spring 10 toward the left side at all times.

The supporting plate shaft spring 10 applies a force to the slide plate 6 and the slide pipes 4 toward the left side at all times. Thus, the supporting plate shaft spring 10 functions as a driving source that shifts the slide plate 6 and the slide pipes 4 toward the left side when the mode is switched to the threading mode.

The upper looper conducting pipe 12 has a linear portion 12*a* to be arranged such that it penetrates a right side surface hole 7*c* formed in the looper pipe supporting plate 7 and the round hole 6*b* formed in the slide plate 6, and further penetrates the slide pipe spring 5 and the slide pipe 4, and such that it penetrates, together with the slide pipe 4, up to a left side surface hole 7*d* formed in the looper pipe supporting plate 7.

The lower looper conducting pipe 13 has a linear portion 13*a* to be arranged such that it penetrates a right side surface hole 7*e* formed in the looper pipe supporting plate 7 and the round hole 6*b* formed in the slide plate 6, and further penetrates the slide pipe spring 5 and the slide pipe 4, and such that it penetrates, together with the slide pipe 4, up to a left side surface hole 7*f* formed in the looper pipe supporting plate 7.

The slide plate 6 has a long hole 6*d* and a heteromorphic long hole 6*h*.

The heteromorphic long hole 6*h* has a long hole portion 6*f* formed such that it extends along the direction in which the slide plate 6 is to be shifted and a wide hole portion 6*e* formed with a wider width than that of the long hole portion 6*f*, and such that it communicates with the long hole portion 6*f*.

Furthermore, the slide plate 6 includes a pin 6*g* in the vicinity of the right-side end thereof such that it protrudes toward the front side.

A slide plate support 14 is fixedly mounted on the unshown sewing machine or otherwise the unit base 55 by means of a screw 22. The slide plate support 14 supports the slide plate 6 and a main shaft fixing outer shaft 24. Furthermore, the slide plate support 14 supports a main shaft fixing operating shaft 16, a main shaft fixing operating arm 20, and a switch limiting arm 19.

The slide plate support 14 is configured such that a pin with E-grooves 14*a* is arranged on one end thereof and another pin with E-grooves 14*a* is arranged on the other end thereof. By respectively fitting the pins with E-grooves 14*a* to the long hole 6*d* and the long hole portion 6*f* formed in the slide plate 6, and by providing an E-shaped snap ring 15 to each pin with E-grooves 14*a* for fixing, the slide plate support 14 slidably supports the slide plate 6.

The slide plate support 14 has a round hole 14*b* at approximately the central position. The main shaft fixing outer shaft 24 is arranged such that it penetrates the round hole 14*b*. The slide plate support 14 has through holes 14*c* and 14*d* in its right half region. The main shaft fixing operating shaft 16 is arranged such that it penetrates the through holes 14*c* and 14*d*. The main shaft fixing operating shaft 16 is rotatably mounted on the slide plate support 14 by means of an E-shaped snap ring 17.

The switch limiting arm (switching limiting portion) 19 is fixed to the main shaft fixing operating shaft 16 arranged in an inner space defined by an approximately U-shaped structure configured as the right side portion of the slide plate support 14. A combination of the U-shaped structure and the E-shaped snap ring 17 prevents the switch limiting arm 19 from fluctuating in the thrust direction. In this state, the switch limiting arm 19 is supported together with the main shaft fixing operating arm 20 such that they can be rotated as a single unit.

A pin 19*a* is provided to an arm of the switch limiting arm 19 configured such that it extends upward. The pin 19*a* is fitted to an arc-shaped long hole 14*e* provided to the right end of the slide plate support 14 such that it can be swung along the arc-shaped long hole 14*e*. By fitting the pin 19*a* to the arc-shaped long hole 14*e*, such an arrangement defines the range in which the switch limiting arm 19 can be swung.

Furthermore, the switch limiting arm 19 has a pin 19*b* extending toward the front side. The pin 19*b* can be engaged with arms 62*c* and 62*d* of a switch interlocking arm 62 as described later.

The main shaft fixing operating arm (main shaft fixing operating arm portion) 20 is fixed to the left end of the main shaft fixing operating shaft 16. The main shaft fixing operating arm 20 is configured to swing, via the main shaft fixing operating shaft 16, together with the switch limiting arm 19 in the form of a single unit. A pin 20*a* is arranged at one end of the main shaft fixing operating arm 20. Furthermore, a main shaft fixing operating spring 21 is applied between the pin 20*a* and a small hole 14*f* formed in the slide plate support 14. The main shaft fixing operating spring 21 applies a force to the main shaft fixing operating arm 20 in a direction that alternately switches between opposite directions across a neutral point. Furthermore, a shaft pin engaging portion 20*b* formed in the shape of a long hole is provided to one end of the main shaft fixing operating arm 20. The shaft pin engaging portion 20*b* is engaged with a fixing inner shaft pin 27 described later. With such a main shaft fixing operating arm 20, by pressing the fixing inner shaft pin 27 via the shaft pin engaging portion 20*b*, such an arrangement is capable of moving a main shaft fixing inner shaft 26 and the main shaft fixing outer shaft 24 in the front-back direction.

The main shaft fixing operating spring 21 applies a force to the main shaft fixing operating arm 20 in a direction that alternately switches between the front direction and the back direction across a neutral point. Furthermore, by fitting the pin 19*a* of the switch limiting arm 19 to the arc-shaped long hole 14*e* of the slide plate support 14, such an arrangement limits the range in which the main shaft fixing operating arm 20 can be swung.

A differentiation ring 71 is fixed to the right end of the main shaft fixing operating shaft 16 by means of screws 71*c*. The differentiation ring 71 is configured in an approximately cylindrical shape. Furthermore, a notch 71*a* is formed in a part of the outer circumferential face of the differentiation ring 71. The differentiation ring 71 is configured to turn together with the main shaft fixing operating shaft 16 as a single unit according to the switching between the threading mode and the sewing mode, thereby shifting the position of the notch 71*a*. Such an arrangement is capable of disabling or otherwise enabling the turning operation of a detection lever 73 described later, thereby controlling the operation of the detection lever 73 for a micro switch 32. That is to say, the differentiation ring 71 and an arm 73*c* of the detection lever 73 described later function as an operation limiting portion (71, 73*c*) that controls the operation of the detection lever 73 according to the position of the swinging main shaft fixing operating shaft 16.

It should be noted that, in the present embodiment, as described above, the main shaft fixing operating shaft 16, the switch limiting arm 19, the main shaft fixing operating arm 20, and the differentiation ring 71 form a swing lever portion arranged such that it can be swung in a predetermined range. Also, a part of the aforementioned components, or otherwise all the aforementioned components, may be integrated so as to form the swing lever portion as a single unit.

The unit base 55 is provided with a switch shaft 55*a* such that it extends toward the front side. It should be noted that the switch shaft 55*a* may be provided to the sewing machine main body or the like. An interlocking arm receiver 61 is inserted into the switch shaft 55*a* and is fixed to the switch shaft 55*a* by means of screws 61*c*. Furthermore, the switch interlocking arm 62 is inserted into the switch shaft 55*a* such that it can be rotated and such that it is positioned on the front side of the interlocking arm receiver 61.

Recesses 61*a* and 61*b* each recessed toward the back direction are formed in the interlocking arm receiver 61 such that they are arranged in the rotation direction.

The switch interlocking arm 62 has a boss portion 62*a*, arms 62*b*, 62*c*, and 62*d*, and a spherical protrusion 62*e*.

The boss portion 62*a* is configured in an approximately rod-shaped hollow structure. The switch shaft 55*a* is arranged such that it penetrates the hollow portion. A washer 63 and an E-shaped snap ring 66 are provided on the front side of the switch interlocking arm 62 such that the switch interlocking arm 62 is interposed between the interlocking arm receiver 61 and the E-shaped snap ring 66, thereby limiting the movement of the switch interlocking arm 62 in the axial direction.

The arm (slide member engaging portion) 62*b* is arranged such that it extends upward from the boss portion 62*a*. The arm 62*b* is arranged such that the right end portion of the tip thereof can be in contact with the pin 6*g* of the slide plate 6. When a threading switching knob 64 described later is turned in a clockwise direction as viewed from the front side, the switch interlocking arm 62 turns together with the threading switching knob 64 such that the arm 62*b* presses the pin 6*g*, thereby shifting the slide plate 6 toward the right side.

The arm (switch engaging portion) 62*c* is provided such that it extends from the upper side of the arm 62*b* toward the right side.

Also, the arm (switch engaging portion) 62*d* is provided such that it extends from the upper side of the arm 62*b* toward the right side.

The pin 19*b* of the switch limiting arm 19 is inserted into an approximately V-shaped space defined between the arms 62*c* and 62*d*. The pin 19*b* is engaged with the arm 62*c* or otherwise the arm 62*d* according to the direction in which the threading switching knob 64 is turned.

The spherical protrusion 62*e* is formed such that it protrudes backward from a portion formed such that it extends downward from the boss portion 62*a*. The spherical protrusion 62*e* is configured to be fitted to the recess 61*a* or otherwise 61*b*, thereby allowing the switch interlocking arm 62 to be temporarily held at a predetermined position after the switch interlocking arm 62 is turned.

A threading switching knob (switch operating portion) 64 is engaged with the boss portion 62*a* of the switch interlocking arm 62, and is fixed to the switch interlocking arm 62 by means of a screw 65. Thus, by operating the threading switching knob 64 so as to swing toward the left side or otherwise the right side (turn within a predetermined range), such an arrangement allows the switch interlocking arm 62 to swing (turn within a predetermined range) together with the threading switching knob 64 in the form of a single unit.

Figure 9:
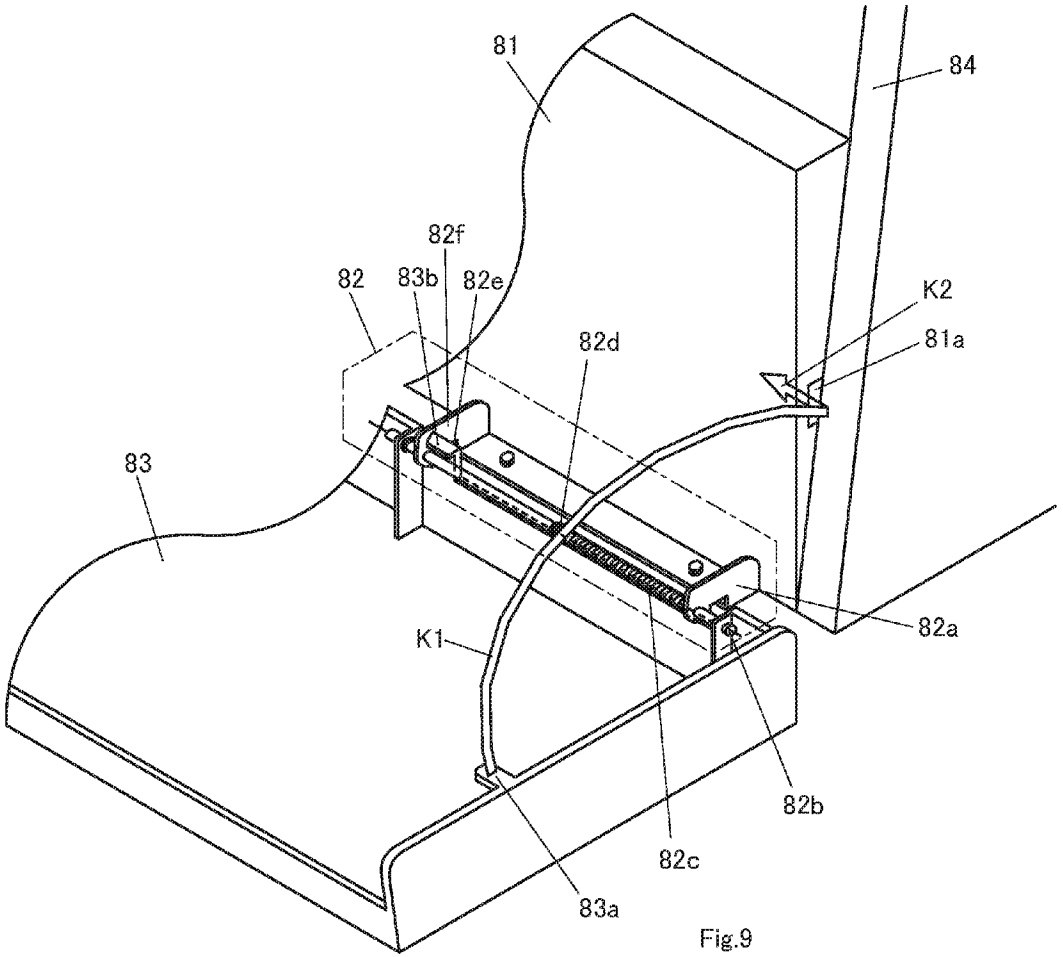
FIG. 9 is an enlarged perspective view showing the components in the vicinity of the hinge of a looper cover 83.

After the manufacturing of the sewing machine is completed, the aforementioned components except for the threading switching knob 64 are configured as an internal configuration within an internal space defined by a front cover 81 (see FIG. 9). The threading switching knob 64 functions as an exterior member via which the user performs an operation.

A looper thread take-up guide 23 is arranged at the left end of the looper thread path C. Two round holes 23*a* and 23*b* are formed in the looper thread take-up guide 23 such that they correspond to the left side surface holes 7*d* and 7*f* formed in the looper pipe supporting plate 7.

The looper thread take-up guide 23 is fixedly mounted on the unshown sewing machine main body or otherwise the unit base 55 by means of screws 57.

The main shaft fixing outer shaft (first shaft) 24 fitted to the round hole 14*b* of the slide plate support 14 has a structure with a hollow interior. A fixing inner shaft spring (shaft spring) 25 and another main shaft fixing outer shaft (second shaft) 26 are inserted into the hollow portion of the main shaft fixing outer shaft 24. Thus, such an arrangement allows the main shaft fixing inner shaft 26 to be relatively shifted along the axial direction of the main shaft fixing outer shaft 24. The main shaft fixing inner shaft 26 is shifted toward the front side or otherwise the back side via a fixing inner shaft pin 27 described later according to the swinging of the main shaft fixing operating arm 20. Furthermore, the fixing inner shaft spring 25 applies a force such that the main shaft fixing outer shafts 24 and 26 move away from each other. Thus, the fixing inner shaft spring 25 functions as a force-applying member for maintaining the main shaft fixing outer shaft 24 at an intermediate position.

Furthermore, the fixing inner shaft pin (shaft pin) 27 is fixed at the front-side end of the main shaft fixing inner shaft 26 via a side surface long hole (engaging portion) 24*a* formed in the main shaft fixing outer shaft 24 such that it protrudes laterally. The fixing inner shaft pin 27 has a function for transferring the swinging of the main shaft fixing operating arm 20 to the main shaft fixing inner shaft 26. The fixing inner shaft pin 27 can be moved in the front-back direction within the range of the side surface long hole 24*a* that is formed in the main shaft fixing outer shaft 24. According to the movement of the fixing inner shaft pin 27, the main shaft fixing inner shaft 26 is moved within a range along the main shaft fixing outer shaft 24. The side surface long hole 24*a* also functions as an engagement portion that engages with the fixing inner shaft pin 27 and that receives a force so as to move the main shaft fixing outer shaft 24 toward a main shaft fixing plate 29 side.

The main shaft fixing plate 29 fixed to a main shaft 28 is arranged on the axial center line of the main shaft fixing outer shaft 24. A notch 29*a* is formed in the outer circumferential face of the main shaft fixing plate 29 at a predetermined phase (that corresponds to the threading phase) such that it can be fitted to one end 24*d* of the main shaft fixing outer shaft 24. When the main shaft fixing outer shaft 24 is shifted to the bottom position (engagement position), the aforementioned one end 24*d* of the main shaft fixing outer shaft 24 is engaged with the notch 29*a*, which sets the main shaft 28 to the threading phase.

Furthermore, the main shaft fixing outer shaft 24 has a small diameter portion 24*b* and a large diameter portion 24*c* that can respectively be engaged with the long hole portion 6*f* and wide hole portion 6*e* of the slide plate 6. By engaging the small diameter portion 24*b* with the long hole portion 6*f*, the slide plate 6 is maintained at the threading position. By engaging the large diameter portion 24*c* with the wide hole portion 6*e*, the slide plate 6 is maintained at the sewing position.

With the aforementioned configuration, by fitting the one end 24*d* of the main shaft fixing outer shaft 24 to the notch 29*a* of the main shaft fixing plate 29, the main shaft fixing outer shaft 24 is capable of setting the main shaft 28 to a predetermined phase. Furthermore, the other end of the main shaft fixing outer shaft 24 is fitted to the heteromorphic long hole 6*h* of the slide plate 6, which allows the slide plate 6 to be held at different positions, i.e., the threading position and the sewing position. Moreover, the main shaft fixing outer shaft 24 houses the fixing inner shaft spring 25, the main shaft fixing inner shaft 26, and the fixing inner shaft pin 27, which form a unit of the main shaft fixing outer shaft 24.

With the overlock sewing machine according to the present embodiment having the aforementioned configuration, the upper looper 1 holding the upper looper thread 58 and the lower looper 2 holding the lower looper thread 59 are driven such that they cross together with a needle thread (not shown) held by a needle so as to form stitching.

The looper thread path C is connected to the main shaft fixing mechanism D and the air flow path switching mechanism B. When the main shaft fixing outer shaft 24 is driven such that it passes through the sewing machine main body or the unit base 55 and is engaged with the notch 29*a* of the main shaft fixing plate 29 fixed to the main shaft 28, the looper thread path C transfers the corresponding looper thread to the upper looper 1 or otherwise the lower looper 2 selected by the looper selecting knob 45 by means of compressed air supplied via the tube 36. The upper looper thread discharge pipe 54*a* and the lower looper thread discharge pipe 54*b* arranged at the end of the air flow path switching mechanism B are respectively coupled with the upper end expanding portion 12*b* of the upper looper conducting pipe 12 and the upper end expanding portion 13*b* of the lower looper conducting pipe 13 each configured as an inlet pipe on the looper thread path C side, and the compressed air is supplied.

The phase at which the main shaft fixing outer shaft 24 meets the notch 29*a* of the main shaft fixing plate 29 is designed such that it matches a timing at which the upper looper receiving opening 1*a* and the lower looper receiving opening 2*a* of the looper portion A are aligned with the extended lines that extend in the horizontal direction from the respective slide pipes 4.

The switching between the threading mode and the sewing mode can be performed according to the switching of the state of the main shaft fixing outer shaft 24 between a state in which it is pressed and shifted toward the main shaft fixing plate 29 side such that it engages with the notch 29*a* and a state in which it is retracted toward the front side such that it disengages from the notch 29*a*. This setting can be made by swinging (turning in a predetermined range) the threading switching knob 64 and operating an unshown flywheel (which rotates in synchronization with the main shaft).

When the mode is to be set to the threading mode, the user turns the threading switching knob 64 in the counterclockwise direction, following which the user rotates the flywheel by hand. When the threading switching knob 64 is turned in the counterclockwise direction, the switch limiting arm 19 and the main shaft fixing operating arm 20 rotate in the clockwise direction as viewed from the right side face of the sewing machine. In this state, a force is applied to the main shaft fixing outer shaft 24 toward the back side (backward direction).

When the notch 29*a* of the main shaft fixing plate 29 matches the position of the main shaft fixing outer shaft 24 in the rotation of the flywheel, the main shaft fixing outer shaft 24 plunges into the notch 29*a* by means of a force applied by the main shaft fixing operating spring 21, thereby engaging the main shaft fixing outer shaft 24 with the notch 29*a*.

When the mode is set to the sewing mode, the user turns the threading switching knob 64 in the clockwise direction. This turns the switch limiting arm 19 and the main shaft fixing operating arm 20 in the counterclockwise direction as viewed from the right side face of the sewing machine. In this state, a force is applied to the main shaft fixing outer shaft 24 toward the front side. In this stage, the slide plate 6 is retracted toward the right side by means of the switch interlocking arm 62. Accordingly, the heteromorphic long hole 6*h* fitted to the small diameter portion 24*b* of the main shaft fixing outer shaft 24 slides laterally, and the small diameter portion 24*b* reaches the wide hole portion 6*e*. In this stage, the outer diameter of the main shaft fixing outer shaft 24 matches the diameter of the wide hole portion 6*e*, and accordingly, the main shaft fixing outer shaft 24 is pressed and shifted toward the front side. As a result, the main shaft fixing outer shaft 24 is disengaged from the notch 29*a* of the main shaft fixing plate 29. In this stage, the mode is switched to the sewing mode.

The safety mechanism E enables the driving of the motor only when a looper cover 83 described later is closed in the sewing mode. That is to say, the safety mechanism E disables the driving of the motor when the mode is set to the threading mode or when the looper cover 83 is open. Thus, the safety mechanism E allows the motor to be driven in only an appropriate condition.

Figure 7:
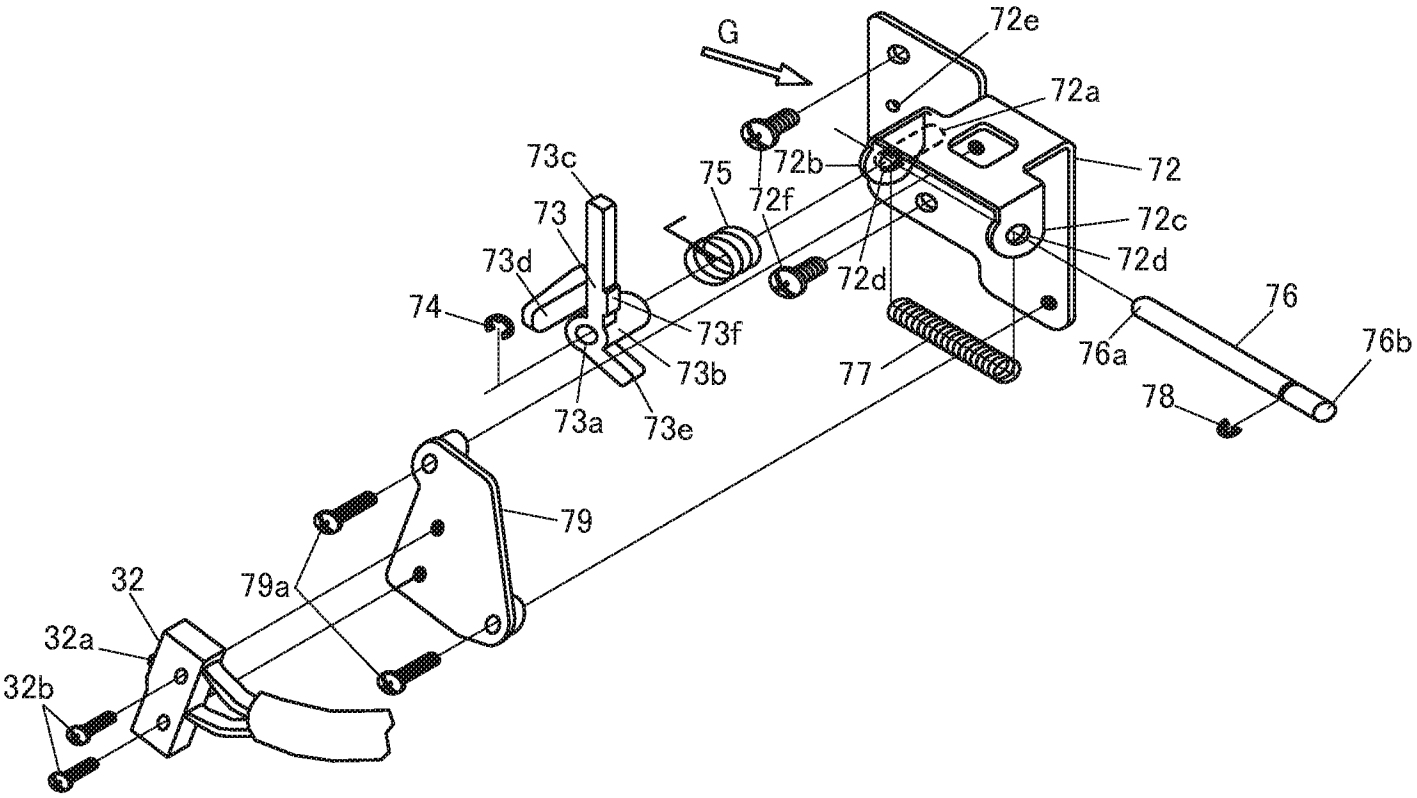
FIG. 7 is an exploded perspective view showing the main components of a safety mechanism E according to the present embodiment.

FIG. 7 is an exploded perspective view showing main components of the safety mechanism E according to the present embodiment.

Figure 8:
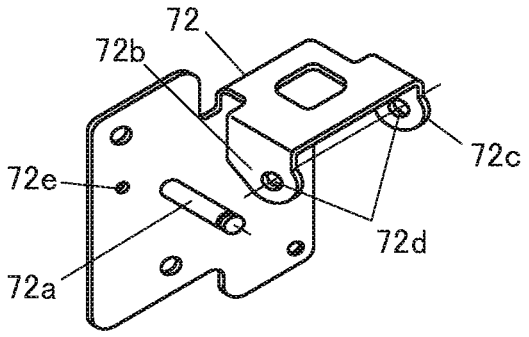
FIG. 8 is a perspective view showing a cover detection base 72 as viewed from the direction indicated by the arrow G shown in FIG. 7.

FIG. 8 is a perspective view of a cover detection base 72 as viewed from the side indicated by the arrow G in FIG. 7.

FIG. 9 is an enlarged perspective view showing a part of the looper cover 83 in the vicinity of a hinge structure.

The cover detection base 72 includes a fixing shaft 72*a* in the vicinity of its central portion, arms 72*b* and 72*c* configured such that the cover detection base 72 has a U shape; through holes 72*d* respectively formed in the arms 72*b* and 72*c*, and a spring hook hole 72*e*. The cover detection base 72 is fixed to the unit base 55 by means of screws 72*f*.

The detection lever 73 has a through hole 73*a* in its central portion. The detection lever 73 is rotatably fitted to the fixing shaft 72*a* of the cover detection base 72, and held by means of an E-shaped snap ring 74. That is to say, the detection lever 73 is arranged such that it can be swung with a rotational axis extending in a direction (front-back direction) that differs from the direction (horizontal direction) in which the rotational axis of the main shaft fixing operating shaft 16 extends. A detection lever spring 75 is fitted to a boss portion 73*b* of the detection lever 73 having the through hole 73*a*. The detection lever spring 75 applies a force to the detection lever 73 in a clockwise direction as viewed from the front side. That is to say, the detection lever spring 75 applies a force to the detection lever 73 toward an operation disable position (described later).

Furthermore, the detection lever 73 further includes an arm 73*c* extending in a direction that is orthogonal to the through hole 73*a*, an arm 73*d* extending from an intermediate portion of the arm 73*c* in parallel with the through hole 73*a*, an arm 73*e* extending in another direction that is orthogonal to the through hole 73*a* and that differs from the direction in which the arm 73*c* extends, and a protrusion 73*f* provided to the right side face of the intermediate portion of the arm 73*c*.

When the detection lever 73 is pressed by a cover detection shaft 76 described later, the detection lever 73 turns so as to shift the arm 73*e* to an operation enable position at which the arm 73*e* presses a micro switch 32 so as to enable the motor driving operation. When the cover detection shaft 76 stops pressing the detection lever 73, the detection lever 73 turns in a clockwise direction as viewed from the front side by means of a force applied by the detection lever spring 75. In this state, the arm 73*e* retracts to the operation disable position at which the arm 73*e* cannot press the micro switch 32, thereby disabling the motor driving operation.

The cover detection shaft 76 is slidably fitted to the through holes 72*d* of the cover detection base 72. Furthermore, a cover detection shaft spring 77 is fitted to the cover detection shaft 76 such that it is arranged between the through holes 72*d*. Furthermore, an E-shaped snap ring 78 is fitted to the right end of the cover detection shaft spring 77. With such an arrangement, the cover detection shaft 76 receives a force toward the right side at all times. That is to say, the cover detection shaft spring 77 applies a force so as to increase a distance between the cover detection shaft 76 and the detection lever 73.

The cover detection shaft 76 is arranged such that its spherical left end 76*a* faces the arm 73*d* of the detection lever 73. When the cover detection shaft 76 is moved toward the left side against the force applied by the cover detection shaft spring 77, the spherical left end 76*a* of the cover detection shaft 76 presses the arm 73*d* of the detection lever 73 toward the left side.

As described above, the cover detection shaft 76 is arranged such that it extends along a direction (horizontal direction) in which the rotational axis of the main shaft fixing operating shaft 16 extends. Furthermore, the cover detection shaft 76 is arranged such that it can be pressed in contact with the detection lever 73, so as to shift the detection lever 73 from the operation disable position to the operation enable position.

The micro switch 32 includes an operating protrusion 32*a*, and is fixed to an insulator base 79 by screws 32*b*. The micro switch 32 operates according to whether or not the arm 73*e* of the detection lever 73 is pressed in contact with the operating protrusion 32*a*. With the micro switch 32 according to the present embodiment, when the operating protrusion 32*a* is pressed and retracted (on state), this enables the motor driving operation. On the other hand, when the operating protrusion 32*a* of the micro switch 32 is not pressed, and accordingly, is in a protruding state (off state), this disables the motor driving operation.

The insulator 79 is formed of an insulating material, and is fixed to the cover detection base 72 by means of screws 79*a*. It should be noted that, in a case in which the micro switch 32 and its terminals are sufficiently insulated, such an insulator base 79 may be omitted.

The mechanism described above with reference to FIG. 1 is in a state in which the looper cover 83 is open, and the threading switching knob 64 is turned to the sewing mode direction (clockwise direction (y1)).

When the threading switching knob 64 is turned in the clockwise direction (Y1) as viewed from the front side, the main shaft fixing operating shaft 16 turns in the counterclockwise direction as viewed from the right side via the pin 19*b* of the switch limiting arm 19. According to this operation, the differentiation ring 71 fixed to the end of the main shaft fixing operating shaft 16 also turns in the counterclockwise direction as viewed from the right side such that its notch 71*a* faces downward.

In this state, the detection lever 73 remains in a state in which its protrusion 73*f* is in contact with the left arm 72*b* of the cover detection base 72 by means of a force applied by the detection lever spring 75.

The cover detection shaft 76 is arranged such that its left end 76*a* faces the arm 73*d* of the detection lever 73. However, in this state in which the looper cover 83 is open, the right end 76*b* of the cover detection shaft 76 is not pressed. Thus, the cover detection shaft 76 remains on the right side.

In this state, the detection lever 73 continues to receive a force applied in the clockwise direction. Thus, the arm 73*e* of the detection lever 73 does not press the operating protrusion 32*a* of the micro switch 32. In this case, the micro switch 32 is turned off, thereby disabling the motor driving operation.

The front cover 81 is arranged on the front side of the overlock sewing machine. The lower portion of the front cover 81 covers the looper thread path C, the main shaft fixing mechanism D, and the safety mechanism E. A looper cover hinge portion 82 is arranged at the lower end of the front cover 81. The looper cover hinge portion 82 includes a hinge 82*a*, a hinge shaft 82*b*, a hinge spring 82*c*, an E-shaped snap ring 82*d*, a hinge notch 82*e*, and a hinge 82*f*.

The looper cover 83 is configured to cover a part of the looper portion A. The looper cover 83 is held by the hinge shaft 82*b* such that it can be turned and swung. Such an arrangement allows the user to open and close the looper cover 83 with respect to the front cover 81.

The hinge spring (looper cover spring) 82*c* is fitted to the hinge shaft 82*b* between the E-shaped snap ring 82*d* fixed to the hinge shaft 82*b* and the hinge 82*a* such that it stores spring energy. The hinge shaft 82*b* is slidably fitted to the hinges 82*a* and 82*f* such that it penetrates the hinges 82*a* and 82*f*. Both ends of the hinge shaft 82*b* are fixedly mounted on the looper cover 83. Accordingly, the hinge spring 82*c* applies a force to the looper cover 83 via the hinge shaft 82*b* toward the left side at all times. Furthermore, when the looper cover 83 is closed, the hinge spring 82*c* applies a force to the looper cover 83 so as to shift the cover detection shaft 76 against the force applied by the cover detection shaft spring 77 and the force applied by the detection lever spring 75, thereby shifting the detection lever 73 from the operation disable position to the operation enable position. It should be noted that the present invention is not restricted to such an arrangement in which the hinge spring 82*c* is fitted to a portion of the hinge shaft 82*b*. Various kinds of springs that can apply such a force to the looper cover 83 may be employed, examples of which include a leaf spring.

The looper cover 83 is provided with a rib 83*b*. When the looper cover 83 is open (in a state shown in FIG. 9), the rib 83*b* comes in contact with the hinge 82*f*, thereby preventing the looper cover 83 from shifting toward the left side beyond this position, thereby defining the position of the looper cover 83. On the other hand, when the loop cover 83 is closed, the rib 83*b* is shifted such that the position (phase) of the rib 83*b* matches that of the hinge notch 82*e*. In this state, the rib 83*b* does not define the position of the looper cover 83.

Furthermore, the looper cover 83 is provided with a right-side face protrusion (pressing portion) 83*a*. The right-side face protrusion 83*a* is configured to enter a window 81*a* formed in the front cover 81 when the looper cover 83 is closed.

When the looper cover 83 is closed after being open as shown in FIG. 9, the looper cover 83 turns in the clockwise direction (K1 direction) as viewed from the right side. Subsequently, when the looper cover 83 comes in contact with the front cover 81 or a belt cover 84, the rib 83*b* of the lower cover 83 which receives a force from the hinge spring 82*c* toward the left side at all times has the same phase as that of the hinge notch 82*e*. In this stage, the rib 83*b* is slid toward the left side, and accordingly, the loop cover 83 itself is slid toward the left side.

In this stage, as indicated by the arrow in FIG. 9, the right-side face protrusion 83*a* enters the window 81*a* (K2 direction) formed in the front cover 81, and engages with the window 81*a*, thereby preventing the looper cover 83 from opening.

Figure 10A:
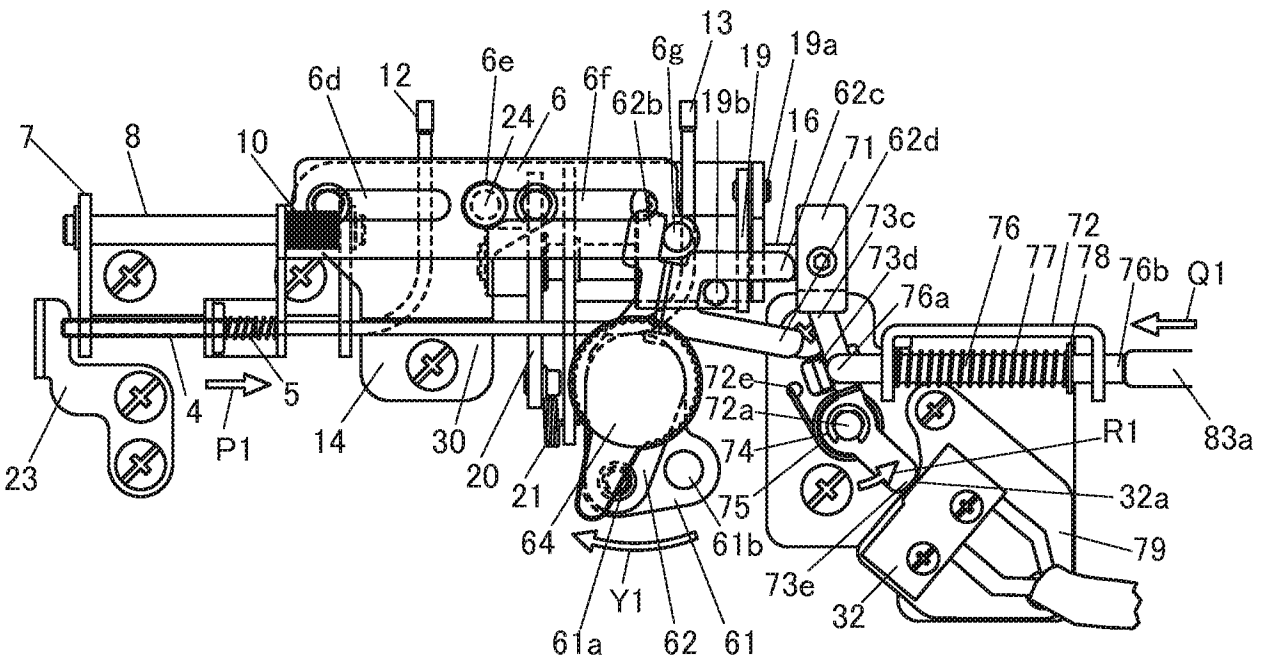
FIG. 10A is a diagram showing the looper thread path C and the safety mechanism E in the sewing mode when the looper cover 83 is closed.

After the right-side face protrusion 83*a* enters the window 81*a* of the front cover 81, the tip of the right-side face protrusion 83*a* presses the right end 76*b* of the cover detection shaft 76 housed in the internal space defined by the front cover 81 (see FIG. 10A).

When the right end 76*b* of the cover detection shaft 76 is pressed by the right-side face protrusion 83*a* of the looper cover 83, the cover detection shaft 76 is slid toward the left side against the force applied by the cover detection shaft spring 77, thereby pressing the arm 73*d* of the detection lever 73.

When the arm 73*d* is pressed by the cover detection shaft 76, the detection lever 73 turns in the counterclockwise direction as viewed from the front side, with the fixing shaft 72*a* of the cover detection base 72 as the center of rotation. With such an arrangement, the state of the detection lever 73 can be classified into two states, i.e., a turn enable state and a turn disable state, which are selected according to the standby position of the differentiation ring 71.

In the state shown in FIG. 1, the looper thread path C is set to the sewing state in which the notch 71*a* of the differentiation ring 71 is directed to the directly downward side. When the looper cover 83 is closed, the arm 73*d* is pressed by the cover detection shaft 76. In this state, the movement of the arm 73*c* of the detection lever 73 is not blocked, and accordingly, the detection lever 73 is able to turn. When the detection lever 73 turns, the other arm 73*e* of the detection lever 73 presses the operating protrusion 32*a* of the micro switch 32, which turns on the micro switch 32, thereby enabling the motor driving operation. It should be noted that, in the aforementioned state shown in FIG. 1, the looper cover 83 is open. In this state, the cover detection shaft 76 is not pressed. Accordingly, the micro switch is turned off.

Next, detailed description will be made regarding the operation of the safety mechanism E of the overlock sewing machine according to the present embodiment.

FIG. 10A is a diagram showing the looper thread path C and the safety mechanism E in the sewing mode when the looper cover 83 is closed.

Figure 10B:
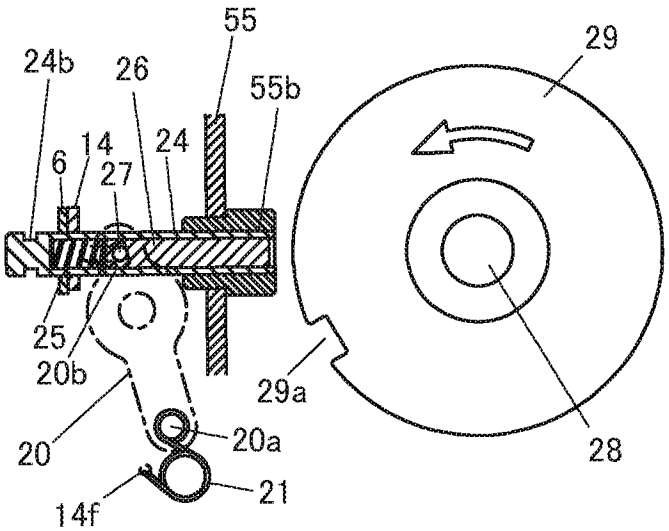
FIG. 10B is a diagram showing the relation between the main shaft fixing operating arm 20, the main shaft fixing outer shaft 24, and the main shaft fixing inner shaft 26 in the sewing mode when the looper cover 83 is closed.

FIG. 10B is a diagram showing the relation between the main shaft fixing operating arm 20, the main shaft fixing outer shaft 24, and the main shaft fixing inner shaft 26 in the sewing mode when the looper cover 83 is closed.

Figure 10C:
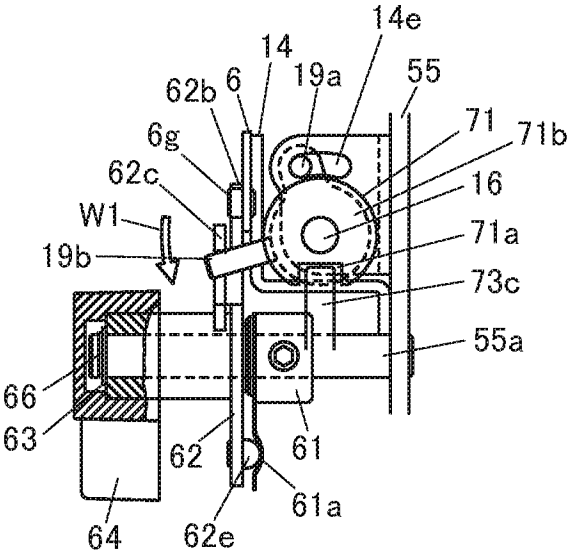
FIG. 10C is a diagram showing the state of the switch limiting arm 19 in the sewing mode when the looper cover 83 is closed.

FIG. 10C is a diagram showing the state of the switch limiting arm 19 in the sewing mode when the looper cover 83 is closed.

When the mode is to be set to the sewing mode, the threading switching knob 64 is turned in the clockwise direction. In this state, the arm 62*c* of the switch interlocking arm 62 presses the pin 19*b* of the switch limiting arm 19 downward, thereby turning the switch limiting arm 19 and the main shaft fixing operating arm 20 in the counterclockwise direction as viewed from the right side of the sewing machine.

Furthermore, the arm 62*b* of the switch interlocking arm 62 presses the pin 6*g* of the slide plate 6 toward the right side, thereby shifting the slide plate 6 toward the right side.

As a result, the wide hole portion 6*e* of the slide plate 6 is shifted such that its position matches that of the main shaft fixing outer shaft 24. In this state, the main shaft fixing outer shaft 24 receives a force toward the front side via the fixing inner shaft pin 27 according to the turning of the main shaft fixing operating arm 20. Accordingly, the main shaft fixing outer shaft 24 is pressed such that it is shifted toward the front side of the sewing machine. Thus, the main shaft fixing outer shaft 24 is disengaged from the notch 29*a* of the main shaft fixing plate 29, thereby enabling the rotation of the main shaft 28.

With the switch interlocking arm 62 that fixedly mounts the threading switching knob 64, when the spherical protrusion 62*e* formed at one end of the switch interlocking arm 62 matches the recess 61*a* of the interlocking arm receiver 61, the switch interlocking arm 62 stably holds the threading switching knob 64 at a position that corresponds to the sewing mode.

In the sewing mode, the slide plate 6 is located at its rightmost position. In this state, the slide plate 6 receives a force toward the left side applied by the plate shaft spring 10. However, the large-diameter portion of the main shaft fixing outer shaft 24 is fitted to the wide hole portion 6*e* of the slide plate 6. Thus, the slide plate 6 cannot be slid toward the left side. In addition, the slide pipes 4 are held at their rightmost positions according to this operation. That is to say, the slide pipes 4 move away in the rightward direction (p1 direction) from the respective fitting positions at which they are fitted to the upper looper receiving opening 1*a* and the lower looper receiving opening 2*a*, thereby setting the slide pipes 4 to the sewing mode.

In the states shown in FIGS. 10A through 10C, the threading switching knob 64 is turned in the Y1 direction. As a result, the main shaft fixing outer shaft 24 retracts from the main shaft fixing plate 29. Furthermore, the differentiation ring 71 also turns (in the W1 direction) such that the notch 71*a* faces directly downward. Thus, the main shaft 28 is able to rotate in this state. Furthermore, the arm 73*c* of the detection lever 73, i.e., the detection lever 73 is able to rotate in this state.

In these states, the looper cover 83 is closed, and accordingly, the right-side face protrusion 83*a* enters the inner space covered by the front cover 81 (Q1 direction), and presses the right end 76*b* of the cover detection shaft 76.

The cover detection shaft 76 thus pressed by the right-side face protrusion 83*a* is slid toward the left side such that its left end 76*a* presses the arm 73*d* of the detection lever 73. This turns the detection lever 73 in the counterclockwise direction (R1 direction) as viewed from the front side with the fixing shaft 72*a* of the cover detection base 72 as the center of rotation. As a result, the arm 73*e* presses the operating protrusion 32*a* of the micro switch 32. Thus, the micro switch 32 is turned on, thereby enabling the motor driving operation.

Figure 11A:
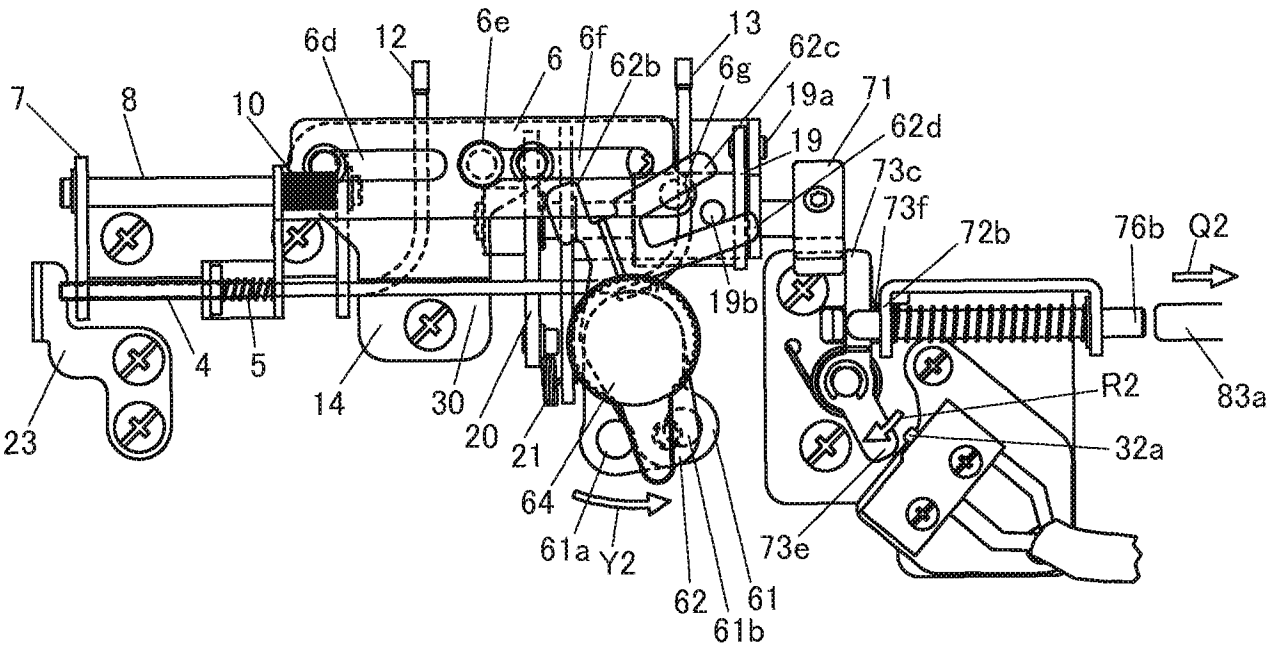
FIG. 11A is a diagram showing the looper thread path C and the safety mechanism E in a transition state in which the threading switching knob 64 is being turned in the counterclockwise direction when the looper cover 83 is open.

FIG. 11A is a diagram showing the looper thread path C and the safety mechanism E in a transition state in which the threading switching knob 64 is being turned in the counterclockwise direction when the looper cover 83 is open.

Figure 11B:
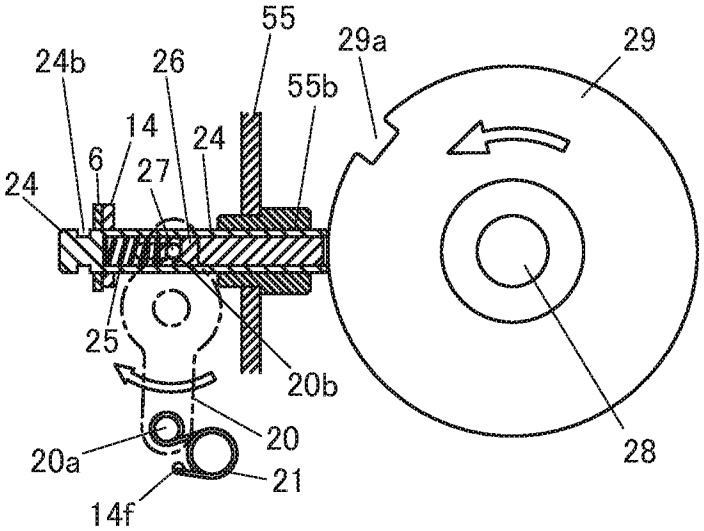
FIG. 11B is a diagram showing the relation between the main shaft fixing operating arm 20, the main shaft fixing outer shaft 24, and the main shaft fixing inner shaft 26 in a transition state in which the threading switching knob 64 is being turned in the counterclockwise direction when the looper cover 83 is open.

FIG. 11B is a diagram showing the relation between the main shaft fixing operating arm 20, the main shaft fixing outer shaft 24, and the main shaft fixing inner shaft 26 in a transition state in which the threading switching knob 64 is being turned in the counterclockwise direction when the looper cover 83 is open.

Figure 11C:
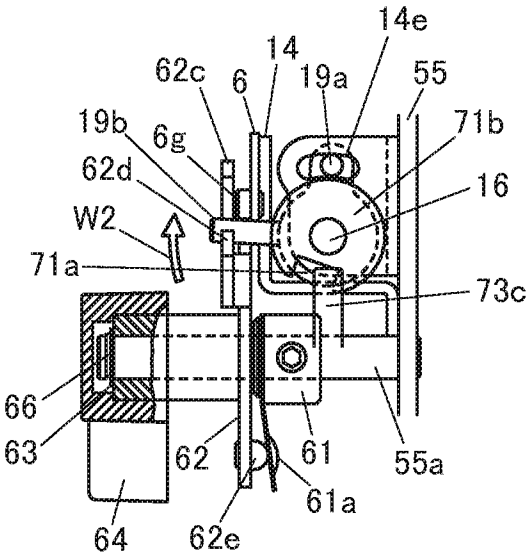
FIG. 11C is a diagram showing the switch limiting arm 19 in a transition state in which the threading switching knob 64 is being turned in the counterclockwise direction when the looper cover 83 is open.

FIG. 11C is a diagram showing the switch limiting arm 19 in a transition state in which the threading switching knob 64 is being turned in the counterclockwise direction when the looper cover 83 is open.

In these states, the threading switching knob 64 is turned in the counterclockwise direction. In this case, the pin 19*b* of the switch limiting arm 19 is pressed and moved upward by the arm 62*d* of the switch interlocking arm 62, and accordingly, the switch limiting arm 19 and the main shaft fixing operating arm 20 turn in the clockwise direction as viewed from the right side of the sewing machine. In this stage, the notch 29*a* of the main shaft fixing plate 29 does not reach the phase at which it is fitted to the main shaft fixing outer shaft 24. As a result, the main shaft fixing outer shaft 24 comes in contact with the outer circumferential face of the main shaft fixing plate 29. It should be noted that the main shaft fixing operating spring 21 applies a force to the main shaft fixing outer shaft 24 toward the axis of the main shaft fixing plate 29 at all times via the main shaft fixing operating arm 20 and the fixing inner shaft pin 27.

The slide plate 6 receives a force toward the left side applied by the supporting plate shaft spring 10. However, in this state, the wide hole portion 6*e* is fitted to the large-diameter portion of the main shaft fixing outer shaft 24. Thus, the slide plate 6 remains in a state in which it cannot be moved toward the left side. As a result, the slide plate 6 and the slide pipes 4 are held at their rightmost positions, as in the sewing mode.

FIGS. 11A through 11C each show a transition state in which the threading switching knob 64 is positioned at an intermediate position before the turning (Y2 direction) of the threading switching knob 64 is complete. In this stage, as shown in FIG. 11C, the turning of the differentiation ring 71 (W2 direction) via the pin 19*b* of the switch limiting arm 19 is not completed, i.e., has not reached the end point. It should be noted that the notch 71*a* of the differentiation ring 71 is turned such that the notch 71*a* does not face directly downward. This prevents the arm 73*c* of the detection lever 73 from turning.

When the looper cover 83 is open, the right-side face protrusion 83*a* of the looper cover 83 retracts toward the right side (Q2 direction). As a result, the cover detection shaft 76 is slid toward the right side according to the force applied by the cover detection shaft spring 77. When the cover detection shaft 76 is slid toward the right side, the detection lever 73 turns in the clockwise direction (R2 direction) as viewed from the front side according to the force applied by the detection lever spring 75. As a result, the arm 73*e* retracts from the position at which it presses the operating protrusion 32*a* of the micro switch 32. Thus, the micro switch 32 is turned off, thereby disabling the motor driving operation.

If the looper cover 83 is closed in this state, the right-side face protrusion 83*a* again enters the inner space covered by the front cover 81 such that it presses the cover detection shaft 76 toward the left side. However, as described above, the differentiation ring 71 prevents the arm 73*c* of the detection lever 73 from turning. Thus, the micro switch 32 is not turned on.

In this state, the tip of the main shaft fixing outer shaft 24 comes in contact with the main shaft fixing plate 29. Thus, the main shaft 28 must not be rotated with a high rotational speed in this state. As described above, the safety mechanism E according to the present embodiment prevents the rotation of the motor in this state.

Figure 12A:
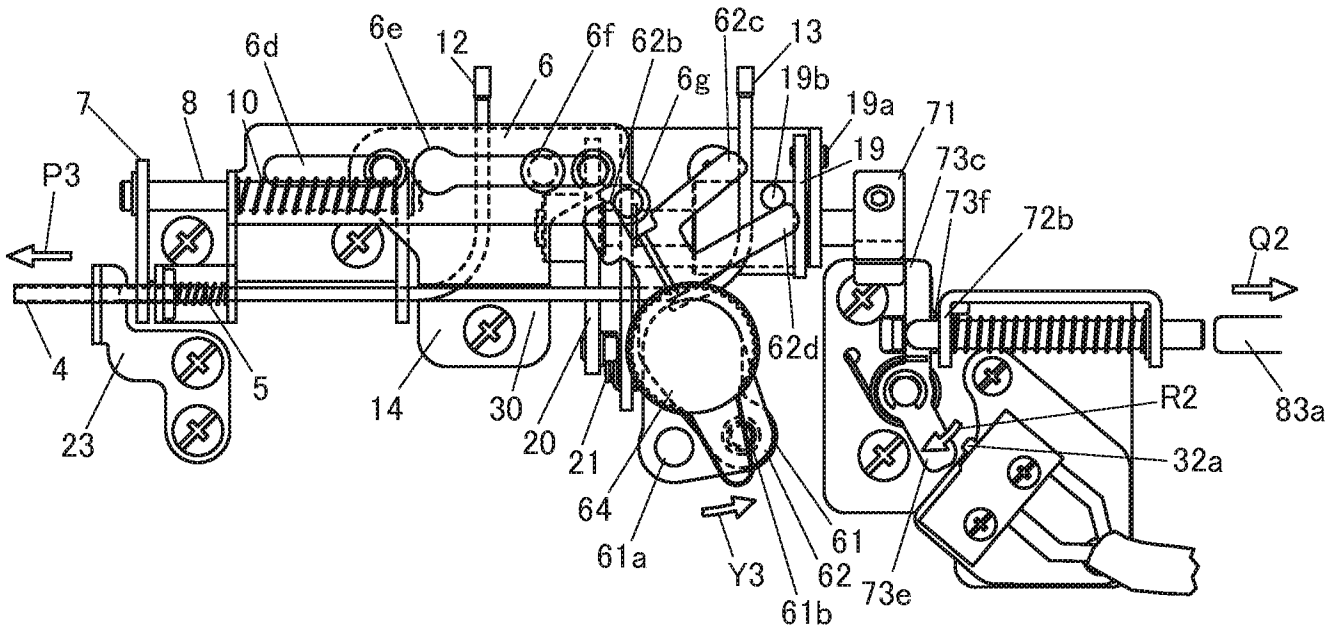
FIG. 12A is a diagram showing the looper thread path C and the safety mechanism E in a state in which the looper cover 83 is open after the switching to the threading mode is complete.

FIG. 12A is a diagram showing the looper thread path C and the safety mechanism E in a state in which the looper cover 83 is open after the switching to the threading mode is complete.

Figure 12B:
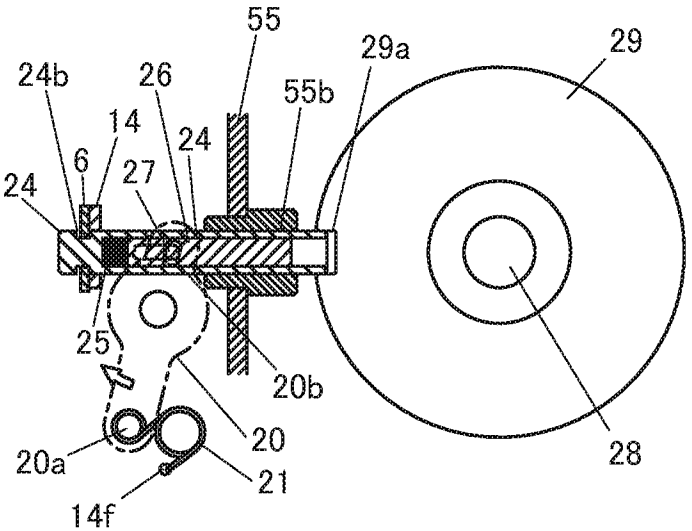
FIG. 12B is a diagram showing the relation between the main shaft fixing operating arm 20, the main shaft fixing outer shaft 24, and the main shaft fixing inner shaft 26 in a state in which the looper cover 83 is open after the switching to the threading mode is complete.

FIG. 12B is a diagram showing the relation between the main shaft fixing operating arm 20, the main shaft fixing outer shaft 24, and the main shaft fixing inner shaft 26 in a state in which the looper cover 83 is open after the switching to the threading mode is complete.

Figure 12C:
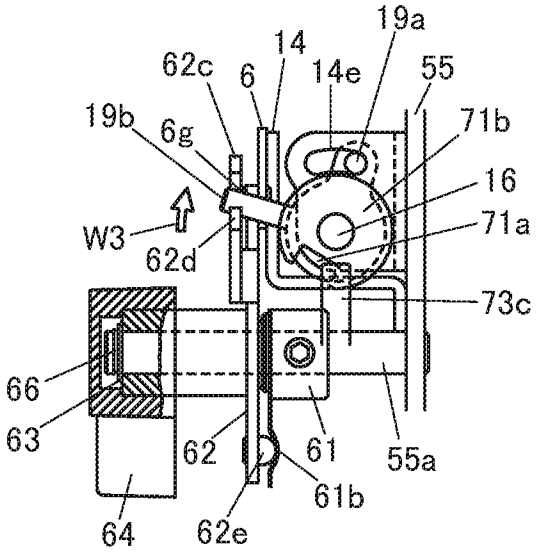
FIG. 12C is a diagram showing the switch limiting arm 19 in a state in which the looper cover 83 is open after the switching to the threading mode is complete.

FIG. 12C is a diagram showing the switch limiting arm 19 in a state in which the looper cover 83 is open after the switching to the threading mode is complete.

When the flywheel (not shown) is manually rotated toward the front side in a state in which the threading switching knob 64 is turned in the counterclockwise direction as shown in FIGS. 11A through 11C, the main shaft fixing plate 29 rotates according to the rotation of the main shaft 28. As a result, the notch 29*a* of the main shaft fixing plate 20 reaches the standby phase at which the main shaft fixing outer shaft 24 stands by. Immediately after the notch 29*a* reaches the standby phase, the main shaft fixing outer shaft 24 receiving a force toward the axis direction of the main shaft fixing plate 29 plunges into the notch 29*a*, thereby fitting the main shaft fixing outer shaft 24 to the notch 29*a*. The main shaft fixing operating spring 21 continues to apply a force to the main shaft fixing outer shaft 24 toward the axis of the main shaft fixing plate 29, thereby maintaining the engagement between them.

When the main shaft fixing outer shaft 24 is shifted toward the back side, the position of the small-diameter portion 24*b* of the main shaft fixing outer shaft 24 matches that of the long hole portion 6*f* of the slide plate 6. Thus, the slide plate 6 is shifted toward the left side according to the force applied by the supporting plate shaft spring 10. According to this operation, the two slide pipes 4 are moved toward the left side (P3 direction) such that the left ends of the respective slide pipes 4 penetrate the round holes 23*a* and 23*b*, and penetrate the upper looper thread hook 3*a* and the lower looper thread hook 3*b* of the looper thread take-up 3. As a result, the two slide pipes 4 respectively reach and are respectively fitted to the upper looper receiving opening 1*a* and the lower looper receiving opening 2*a*.

With the switch interlocking arm 62 that fixedly mounts the threading switching knob 64, when the spherical protrusion 62*e* formed at one end of the switch interlocking arm 62 matches the recess 61*b* of the interlocking arm receiver 61, the switch interlocking arm 62 stably holds the threading switching knob 64 at a position that corresponds to the threading mode.

In the states shown in FIGS. 12A through 12C, as described above, the main shaft fixing outer shaft 24 is shifted to the bottom position. In this stage, the turning (Y3 direction) of the threading switching knob 64 has been completed via the transition state as shown in FIGS. 11A through 11C. In this state, the turning (W3 direction) of the differentiation ring 71 via the pin 19*b* of the switch limiting arm 19 has been completed. In this stage, the orientation of the notch 71*a* changes such that it sufficiently deviates from the directly downward direction. Thus, such an arrangement continues to prevent the arm 73*c* of the detection lever 73 from turning. As a result, the micro switch 32 remains in the off state, and accordingly, the micro switch 32 is not turned on.

When the looper cover 83 is opened or closed, the operation of the safety mechanism E in the state shown in FIGS. 12A through 12C are the same as that in the state shown in FIGS. 11A through 11C. Thus, in this state, the micro switch 32 is not turned on.

As described above, in the present embodiment, the differentiation ring 71 is further provided, and a part of a typical cover open/closed detection configuration is modified (specifically, the arm 73*c* is provided to the detection lever 73, and is arranged such that it faces the differentiation ring 71). Such an arrangement provides an overlock sewing machine having a simple configuration that requires only a single micro switch 32 to detect whether or not the mode is switched between the threading mode and the sewing mode, and to detect whether or not the looper cover is open or closed.

Thus, there is no need to increase the number of such micro switches. Furthermore, such an arrangement requires only a small increase in the number of components for the safety mechanism. Thus, such an arrangement provides an overlock sewing machine having a simple configuration and a compact size in a simple manner while securing high safety. Furthermore, such a simple configuration provides the safety mechanism with improved reliability.

It should be noted that the present invention is not restricted by the embodiments described above.

DESCRIPTION OF THE REFERENCE NUMERALS

A looper portion
B air flow path switching mechanism
C looper thread path
D main shaft fixing mechanism
E safety mechanism
1 upper looper
1*a* upper looper receiving opening
1*b* pipe-like member
1*c* upper looper point
2 lower looper
2*a* lower looper receiving opening
2*b* pipe-like member
2*c* lower looper point
3 looper thread take-up
3*a* upper looper thread hook
3*b* lower looper thread hook
4 slide pipe
4*a* flange portion
4*b* one end of slide pipe
4*c* the other end of slide pipe
5 slide pipe spring
6 slide plate (slide member)
6*a* U groove
6*b* 6*c* round hole
6*d* long hole
6*e* wide hole
6*f* long hole portion
6*g* pin
6*h* heteromorphic long hole
7 looper pipe supporting plate
7*a*, 7*b* through hole
7*c*, 7*e* right side surface hole
7*d*, 7*f* left side surface hole
8 supporting plate shaft
9, 15, 17, 66, 74, 78, 82*d* E-shaped snap ring
10 supporting plate shaft spring
12 upper looper conducting pipe
12*a* linear portion
12*b* upper end expanding portion
13 lower looper conducting pipe
13*a* linear portion
13*b* upper end expanding portion
14 slide plate support
14*a* pin with E-grooves
14*b* round hole
14*c*, 14*d* through hole
14*e* arc-shaped long hole
14*f* small hole
16 main shaft fixing operating shaft
19 switch limiting arm (switch limiting portion)

19*a* pin
19*b* pin
20 main shaft fixing operating arm
20*a* pin
20*b* shaft pin engaging portion
21 main shaft fixing operating spring
23 looper thread take-up guide
23*a*, 23*b* round hole
24 main shaft fixing outer shaft (first shaft)
24*a* side surface long hole (engaging portion)
24*b* small diameter portion
24*c* large diameter portion
24*d* one end of the main shaft fixing outer shaft
25 fixing inner shaft spring (shaft spring)
26 main shaft fixing inner shaft (second shaft)
27 fixing inner shaft pin (shaft pin)
28 main shaft
29 main shaft fixing plate
29*a* notch
32 micro switch
32*a* operating protrusion
36 tube
44 branching body
45 looper selecting knob
48*a* upper looper thread inserting hole
48*b* lower looper thread inserting hole
50 branching base plate
51 screw
54*a* upper looper thread discharge pipe
54*b* lower looper thread discharge pipe
55 unit base
55*a* switch shaft
58 upper looper thread
59 lower looper thread
61 interlocking arm receiver
61*a*, 61*b* recess, 61*c* screw
62 switch interlocking arm (switch interlocking portion)
62*a* boss portion
62*b* arm (slide member engaging portion)
62*c* arm (switch engaging portion)
62*d* arm (slide member engaging portion)
62*e* spherical protrusion
63 washer
64 threading switching knob (switch operating portion)
71 differentiation ring
71*a* notch
72 cover detection base
72*a* fixing shaft
72*b* arm
72*c* arm
72*d* through hole
72*e* spring hook hole
73 detection lever
73*a* through hole
73*b* boss portion
73*c* arm
73*d* arm
73*e* arm
73*f* protrusion
75 detection lever spring
76 cover detection shaft
76*a* left end
76*b* right end
77 cover detection shaft spring
79 insulator base
81 front cover
81*a* window
82 looper cover hinge portion
82*a* hinge
82*b* hinge shaft
82*c* hinge spring
82*e* hinge notch
82*f* hinge
83 looper cover
83*a* right-side face protrusion (pressing portion)
83*b* rib
84 belt cover

What is claimed is:

1. An overlock sewing machine comprising:

a swing lever portion arranged such that the swing lever portion can be swung in a predetermined range such that the swing lever is set to an enable position in a stationary state when rotation of a main shaft is to be enabled, and such that the swing lever is swung and shifted to a position away from the enable position when the rotation of the main shaft is to be disabled;

a switch that switches a motor configured to drive the main shaft between a driving enable state and a driving disable state;

a detection lever arranged such that the detection lever can be swung with a swinging axis that extends in a direction that differs from the direction in which a swinging axis of the swing lever portion extends, and configured to be swung between an operation enable position at which the switch is set to the motor driving enable state and an operation disable position at which the switch is set to the motor driving disable state, wherein the swinging axis of the detection lever is configured at a skew position with respect to the swing axis of the swing lever portion;

a detection lever spring that applies a force to the detection lever toward the operation disable position;

a cover detection shaft arranged such that it extends along a direction in which the swinging axis of the swing lever portion extends, and configured such that it can be shifted to a position so as to press and shift the detection lever from the operation disable position to the operation enable position;

a cover detection shaft spring that applies a force to the cover detection shaft so as to increase a distance between the cover detection shaft and the detection lever;

a looper cover arranged so as to cover at least a part of the looper, and configured to be opened and closed;

a pressing portion configured to be shifted together with the looper cover as a single unit, and to press the cover detection shaft such that the cover detection shaft approaches the detection lever when the looper cover is set to a closed position;

a looper cover spring that applies a force to the looper cover such that, when the looper cover is set to a closed state, the cover detection shaft is shifted against the force applied by the cover detection shaft spring and the force applied by the detection lever spring so as to shift the detection lever from the operation disable position to the operation enable position; and an operation limiting portion that limits an operation of the detection lever according to the position of the swing lever portion such that, when the swing lever portion is set to the enable position, the detection lever can be swung and shifted to the operation enable position, and such that, when the swing lever portion is not set to the enable position, the detection lever cannot be swung and shifted to the operation enable position.

2. The overlock sewing machine according to claim 1, comprising:

at least one looper having a receiving opening that receives a looper thread and having a hollow structure through which the looper thread can pass;

a thread insertion opening into which the looper thread is to be inserted such that the looper thread passes through the looper;

a looper conducting pipe that guides the looper thread inserted into the looper inserting opening to the receiving opening;

a slide pipe arranged between the looper conducting pipe and the receiving opening such that one end thereof is slidably fitted to the looper conducting pipe, such that the other end thereof can be shifted between a threading position at which the other end thereof is connected to the receiving opening and a sewing position at which the other end thereof is distant from the receiving opening;

a slide member configured to hold the slide pipe and to be shifted together with the slide pipe between the threading position and the sewing position, and having a long hole portion that extends along a direction in which the slide member is to be shifted, and a wide hole portion configured to have a width that is greater than that of the long hole portion, and to communicate with the long hole portion;

a slide member spring that applies a force to the slide member and the slide pipe toward the receiving opening side;

a main shaft to be rotationally driven;

a main shaft fixing plate fixed to the main shaft and having a notch at a position on an outer circumferential face that corresponds to a threading phase at which the receiving opening can be connected to the aforementioned other end of the slide pipe;

a first shaft configured such that one end thereof can be shifted between an engagement position at which the aforementioned one end thereof is engaged with the notch so as to set the main shaft to the threading phase and a retracted position at which there is a sufficient distance between the aforementioned one end thereof and the main shaft fixing plate, and such that the other end thereof has a small-diameter portion to be engaged with the long hole portion of the slide member and a large-diameter portion to be engaged with the wide hole portion of the slide member, and configured such that the small-diameter portion and the large-diameter portion can respectively be engaged with the long hole portion and the wide hole portion so as to allow the position of the slide member to be set to the threading position and otherwise the sewing position;

a second shaft configured to be relatively shifted along the axial direction of the first shaft;

a shaft spring that applies a force so as to increase a distance between the first axis and the second axis;

a shaft pin configured such that it protrudes from the second shaft, or is otherwise configured as a shaft pin engaged with the second shaft such that it can be shifted together with the second shaft as a single unit in an axial direction of the second shaft;

an engaging portion provided to the first shaft, and engaged with the shaft pin and/or the second shaft so as to receive a force that shifts the first shaft toward the main shaft fixing plate side, wherein the swing lever portion comprises a main shaft fixing operating arm portion including a shaft pin engaging portion engaged with the shaft pin or otherwise the shaft pin itself, and a switch limiting portion that can be swung together with the main shaft fixing operating arm portion as a single unit, and wherein the overlock sewing machine further comprises:

a main shaft fixing operating spring configured to apply a force in a direction that is switched between both directions in which the swing lever portion can be swung when the swing lever portion is swung across a neutral position;

a switch operating portion provided so as to allow a user to perform an operation; and a switch interlocking portion comprising a switch engaging portion engaged with the switch limiting portion, and configured to operate so as to swing the swing lever portion according to an operation performed via the switch operating portion, and a slide member engaging portion that can be engaged with the slide member so as to shift the position of the slide member to the sewing position when the switch operating portion is set to the sewing position.

* * * * *